United States Patent [19]

Lamp

[11] Patent Number: 4,989,671

[45] Date of Patent: Feb. 5, 1991

[54] GAS AND OIL WELL CONTROLLER

[75] Inventor: Lawrence R. Lamp, Millersburg, Ohio

[73] Assignee: Multi Products Company, Millersburg, Ohio

[21] Appl. No.: 393,065

[22] Filed: Aug. 7, 1989

Related U.S. Application Data

[63] Continuation of Ser. No. 56,461, May 29, 1987, abandoned, Continuation-in-part of Ser. No. 747,344, Jul. 24, 1985, abandoned.

[51] Int. Cl.[5] ..... E21B 34/16; E21B 43/12

[52] U.S. Cl. ..... 166/53; 137/624.2; 166/64; 166/66; 166/372

[58] Field of Search ..... 166/53, 64, 65.1, 68, 166/369, 372, 373, 66; 137/487.5, 624.2; 364/569, 420, 422

[56] References Cited

U.S. PATENT DOCUMENTS

| | | | |
|---|---|---|---|
| 3,266,574 | 8/1966 | Gandy | 166/53 |
| 3,863,714 | 2/1975 | Watson, Jr. | 166/53 |
| 4,150,721 | 4/1979 | Norwood | 166/53 |
| 4,215,746 | 8/1980 | Hallden et al. | 166/53 |
| 4,352,367 | 10/1982 | Norwood | 137/624.15 |
| 4,355,365 | 10/1982 | McCracken et al. | 166/64 X |
| 4,410,038 | 10/1983 | Drapp | 166/53 |
| 4,526,228 | 7/1985 | Wynn | 166/53 |
| 4,596,516 | 6/1986 | Scott et al. | 166/53 X |
| 4,629,004 | 12/1986 | Griffin | 166/372 |
| 4,633,954 | 1/1987 | Dixon et al. | 166/64 X |
| 4,664,602 | 5/1987 | Gordon | 166/53 X |

OTHER PUBLICATIONS

Instruction Booklet for MAX I Pressure Controller, TIMAX, MAX III, 1985 Multi Products, Inc.

*Primary Examiner*—Hoang C. Dang

*Attorney, Agent, or Firm*—Fay, Sharpe, Beall, Fagan, Minnich & McKee

[57] ABSTRACT

A gas and oil well controller includes a microcomputer control circuit which can control well production by monitoring well pressure levels, by time limitations, or any combination of the two. The controller includes a casing pressure sensor, a tubing pressure sensor, and a line pressure sensor for sensing pressure in the sales line, and a plunger position sensor for sensing the position of a plunger adjacent a top position in the well tubing. The microcomputer control circuit is in operative communication with the production valve, the casing pressure sensor, tubing pressure sensor, the line pressure sensor and the plunger sensor to open and close the production valve for gas flow to the sales line when the casing, tubing, and line pressures bear a predetermined relationship to preselected pressure limits or when the plunger is sensed by the plunger sensor. The controller includes a device for preselecting limit delays to suspend valve operations during pressure surges to avoid premature opening or closing. A device for preselecting a purge delay allows a purging of fluids from the well tubing after the plunger has reached the top of the tubing when the production valve would normally close. An auxiliary production valve is provided for the transmission of well fluids directly to a fluid storage tank bypassing the sales line as necessary, or for the introduction of injection gas into the casing.

10 Claims, 15 Drawing Sheets

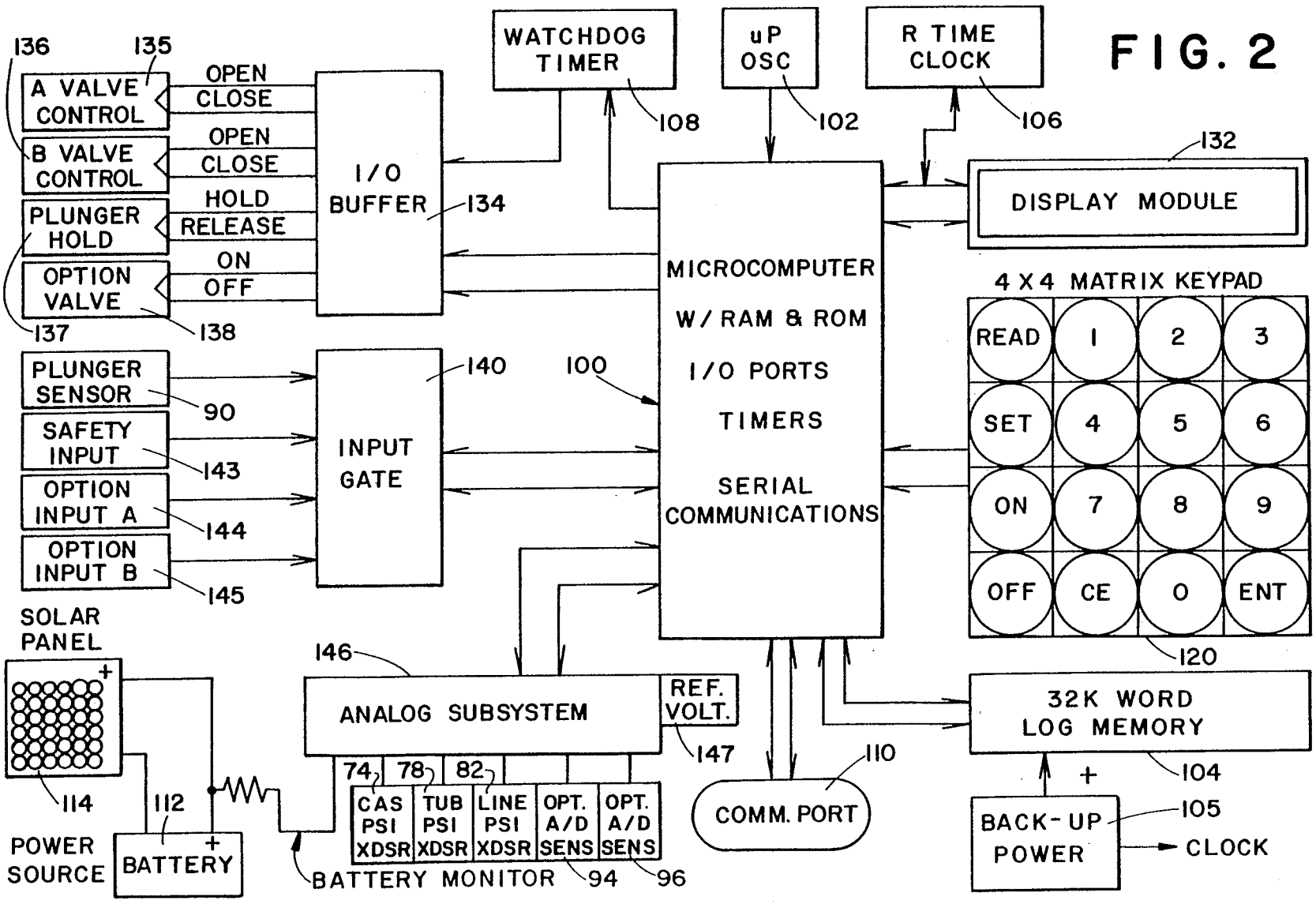
FIG. 2
DISPLAY MODULE
132
4 X 4 MATRIX KEYPAD
READ
SET
ON
OFF
1
4
7
CE
2
5
8
0
3
6
9
ENT
120
32K WORD LOG MEMORY
104
BACK-UP POWER
105
CLOCK
R TIME CLOCK
106
uP OSC
102
WATCHDOG TIMER
108
MICROCOMPUTER
W/RAM & ROM
I/O PORTS
TIMERS
SERIAL COMMUNICATIONS
100
COMM. PORT
110
REF. VOLT.
147
ANALOG SUBSYSTEM
146
OPT. A/D SENS
96
OPT. A/D SENS
94
LINE PSI XDSR
82
TUB PSI XDSR
78
CAS PSI XDSR
74
BATTERY MONITOR
I/O BUFFER
134
INPUT GATE
140
OPEN CLOSE
OPEN CLOSE
HOLD RELEASE
ON OFF
138
A VALVE CONTROL
135
B VALVE CONTROL
136
PLUNGER HOLD
OPTION VALVE
137
PLUNGER SENSOR
90
SAFETY INPUT
143
OPTION INPUT A
144
OPTION INPUT B
145
SOLAR PANEL
114
BATTERY
112
POWER SOURCE

GAS AND OIL WELL CONTROLLER

This is a continuation of copending application(s) Ser. No. 07,056,461 filed on May 29, 1987, which is a C-I-P of Ser. No. 747,344 filed on Jul. 24, 1985, both now abandoned.

BACKGROUND OF THE INVENTION

This invention pertains to the art of control systems and more particularly to a controller for regulating fluid flow in a pressurized fluid system with attention to various time, pressure and safety parameters.

The invention is particularly applicable to a controller for gas and oil wells including a plunger lift device for maximizing production and efficiency by selectively regulating production and shut-in through close supervision of time, pressure and safety parameters. The production may be controlled by pressure only, time only, or any combination of the two. In addition, a plunger arrival sensor and delay time programming allows for selective operation to further maximize production and efficiency. However, it will be appreciated by those skilled in the art that the invention could be readily adapted for use in other environments as, for example, where similar control devices and systems are employed to control and regulate other types of fluid transmission and communication.

Gas and oil wells typically have varying production characteristics attributable to such well factors as depth, the types and quantity of fluids present in the well, and the natural gas "rock" pressure. Fluid accumulations in the well tubing particularly inhibit the gas production and, accordingly, should be removed. Such fluid accumulations are usually comprised of salt water and oil. Accordingly, dependent upon the particular characteristics of the well, differing well operating techniques are necessary to adapt to and handle these factors and thereby optimize production.

Some oil and gas wells are produced by using the plunger lift method by which a plunger lifts the liquids (e.g. oil, water) out of the well tubing by using the gas pressure in the casing of the well. The standard method of producing such wells is by a time "on" and time "off" cycle. An "on" period means that a designated time or pressure has been reached and a flow valve is opened which vents the pressure in the well tubing and allows the plunger to come to the top of the well bringing oil or water ahead of it. After the plunger has arrived at the top of the well, gas is allowed to flow out of the well through the well tubing. An "off" period means that the flow valve is closed, the plunger falls to the bottom of the well tubing and the well is sitting idle accumulating gas pressure, which will be used to move the plunger during the "on" cycle, and liquids.

Most wells employ a controller system which alternately shuts-in the well for pressure accumulation in the well casing and then opens it to allow the expelling of gas and fluids through a tubing received in the casing. The various forms and types of well controllers that have heretofore been suggested and employed in the industry have met with varying degrees of success. It has been found that the defects present in most prior well controllers are such that the controllers themselves are of limited economic and practical value.

To better understand the control functions and capabilities of the present invention, a comparison with previous controllers must be made. The present invention will not only perform all of the functions of all the controller types, but has incorporated additional functions to resolve their shortcomings. Functions beyond the capabilities of previous controllers have also been incorporated to provide production versatility not previously available to the producer.

One method of oil and gas production is by means of a simple open/close time cycle controller or variation thereof. An improvement over the simple timer is shown in U.S. Pat. No. 4,150,721 issued to Norwood. The Norwood controller can modify its preset production time cycle by inputs from manually set pressure switches located on the casing, tubing, or sales line and by limit switches which can indicate low flow rate, plunger arrival, or fluid storage full. The actuation of any of the limit switches performs only one of two functions; that is, the initiation of open time or the initiation of close time.

U.S. Pat. No. 4,355,365 issued to McCraken is similar to the Norwood controller. The open cycle time may be initiated by a high limit input from a manually set pressure limit switch on the casing. The close cycle time may be initiated from any low or off limit input from the manually set pressure limit switches on the casing, tubing, or sales line or by the switch indicating plunger arrival. The McCraken controller will also extend the open cycle time by the duration of a high limit input or extend the close cycle time by the duration of a low or off limit input to insure a full time count per cycle.

The manual pressure switches used by both Norwood and McCraken are of the Murphy switch type and may not be set to accurate pressure settings nor may the high and low limit contacts be set within 50 psi. The switches are subject to premature actuation due to pressure fluctations or vibrations during the production cycle. Neither the Norwood nor the McCraken controllers address the problem of premature termination of time cycle by fluctating pressures. During the open cycle, the pressure measured at the tubing and sales line may exceed preset limits due to the passage of the fluid slug. It would be desirable to use analog pressure transducers with an accuracy greater than 1 psi which provide for limits within 2 psi and are resistant to vibration. It would be desirable to prevent the premature shut-in of a well by providing a programmable limit delay time. If a pressure limit setting has been exceeded, the delay time will begin to time out. If at the end of the delay time, the pressure is again within the limit settings, no action will be taken. If at the end of the limit delay time the pressure still exceeds its limit, the well will shut in.

Another problem with previous time cycle production control systems is the failure of the controllers to provide a means for synchronization of several producing wells into a common sales line. This is more desirable with a field of low volume or stripper wells. A producing well with relatively low rock pressure will not be able to discharge its gas into a sales line which has greater pressure. The stronger wells must be shut-in to permit the weaker wells to produce. Timing of the various wells is important as fluid may build and load up the weaker wells. A time cycle controller must be used but must also have pressure limits and conditional inputs for safety. The Norwood and McCraken controllers have the pressure limits and conditional safety inputs but neither are suitable for synchronization for their time cycles are modified by the inputs. The McCraken controller extends its time cycle with the inputs and both McCraken and Norwood controllers terminate the open cycle and transfer the close cycle time low limit or off inputs.

It would be desirable to maintain a 'constant time' with reference to the open and close cycles. All wells feeding the common sales line may then be assigned an operating period synchronized to within one second from any given time. This permits the individual wells the opportunity to produce at their optimum. The safety and line pressure limits would override an open cycle to close the main production valve only as long as the input condition exists. The time cycle would not be modified and the production valve would reopen for the duration of the open cycle when the line pressure limit or input condition no longer is active. If during the shut in condition of the open cycle, the open cycle time is complete, the close time would be transferred and the well would remain shut in.

It is desirable in colder climates to purge the remaining fluids from the production line upon completion of the fluid discharge cycle to prevent the accumulation of thickening or freezing solids. Previous time cycle controllers do not provide for this function. As shown in the Norwood and McCraken disclosures, when the control device is used with a plunger lift well, the open cycle is terminated upon arrival of the plunger and the production valve will immediately shut. The McCraken controller provides a means of switching out the plunger input and the plunger input may be removed from the Norwood controller to permit shut in on time out or low pressure limits. This will allow the production valve to remain open after the passage of the fluids for the continued sale of gas and incidentally purge the line. However, this method will greatly decrease the potential production for most wells.

It would be desirable to provide a programmable purge delay time. The function of the purge delay time would be to delay the closing of the main production valve after the passage of the fluid slug. During the purge delay time, which would be initiated with the arrival of the plunger, gas would be discharged through the production line. Upon time out of the purge delay time, the main production valve would be permitted to close. This is an override and does not affect any system times or cycles. If a safety or line pressure limit is active during the purge operation, the production valve may be temporarily closed until the shut-in condition ceases.

Most wells, even predominant gas wells, will produce a certain quantity of fluids. If the fluid is not expelled periodically, it will eventually load up and restrict the gas production. A time cycle controller may be improved to include a means for the production of gas wells independent of absolute cycle times. The Norwood and McCraken controllers both provide an input for high casing pressure turn-on. The controllers are usually used with a plunger lift system to provide efficient removal of the fluid content. A problem occurs, however, with the time cycle controllers when the rock (casing) pressure of the well remains high for an extended period of time. Upon the plunger arrival during the open cycle, the controllers initiate the close cycle and begin to close the production valve. If the casing pressure is still above the limit, the controller will immediately try to initiate the open cycle. The plunger will therefore oscillate near the top of the tubing as the production valve alternately toggles between open and close. The actual operating speed of the production valve is quite slow compared to the alternate commands it is receiving and therefore will remain open until the high casing pressure falls below the preset low limit. This may permit an excessive amount of fluid to enter the tubing, which in turn, restricts the discharge of gas and therefore maintains the high casing pressure. Raising the pressure limit on the casing switch may correct the problem, but it will also reduce the production of gas and possibly create a very dangerous situation if the plunger is driven hard with little fluids into the receiving mechanism at the surface.

The previous time cycle controllers would also remove the plunger arrival input from the circuit to prevent premature termination of the gas sales upon the plunger arrival. Failure to monitor the plunger arrival could have serious consequences. The plunger provides a partial seal between gas and fluid, reduces fluid fallback, and more efficiently uses gas lift energy; however, the plunger is also used to remove paraffin and scale from the tubing walls and may occasionally hang up. An expensive swabbing operation may then be required to remove the fluids after freeing the plunger if the available casing pressure is insufficient to discharge the accumulated fluids.

To address this problem, it would be desirable to use a special delay in the time cycle mode of operation or to operate in the full differential controller mode. A programmable plunger delay would be provided for use in the time cycle control mode to insure the return of the plunger to the bottom of the tubing after arrival with the fluid slug. This delay would not be overriden by any open pressure limit or input until time out. If the casing pressure remains high for an extended time, the purge delay time would be set to provide sufficient additional gas sales after the plunger arrival. The plunger delay would be set to insure the return of the plunger to the bottom of the tubing for removal of any accumulated fluids. A programmable shut in time would also be provided to monitor the plunger arrival within a specific time period and prevent the accumulation of fluids if the plunger hangs-up.

A predominant gas well may be better produced with a differential type controller which initiates the production cycle on pressure and fluid accumulation. U.S. Pat. No. 3,266,574 issued to Gandy is an early attempt to produce gas wells which have very little fluid content. The method of production was an improvement over the time cycle method at the time because the fluids were discharged directly through a separate fluid production valve into fluid storage tanks. If the fluid production valve remained open after the passage of the fluid slug, then gas was discharged into the atmosphere for the remainder of the open time cycle. The Gandy device was always used with a time cycle controller and would inhibit the opening of the fluid production valve until the pressure differential between the casing and tubing indicated sufficient fluids were accumulated to permit expulsion during the time cycle controller's open cycle. The production gas was fed directly into the sales line but was restricted to prevent entry of fluids by natural flow.

U.S. Pat. No. 3,863,714 issued to Watson is an improved differential controller which uses only one production valve to discharge both the gas and fluid components. The controller will open the production valve when the tubing pressure is sufficient to discharge both gas and fluid accumulations into the sales line. The flow rate between the tubing and sales line is then monitored. A decrease in the flow rate will indicate an accumulation of fluids or the depletion of available rock pressure.

When the flow rate drops below the preset value of the flow switch, the controller will close the production valve until tubing pressure has again increased sufficiently to initiate the restart of the cycle. The controller makes no provisions for conditional operation as is required with plunger lift wells.

U.S. Pat. No. 4,526,228 issued to Wynn is an improved version of the differential controller which has been enhanced to modify the production cycle with time and pressure limits. It also incorporates inputs for plunger arrival and safety limits. The Wynn controller uses a gas production valve connected to an oil and gas separator and fluid production valve directly connected to a fluid storage tank. If the casing pressure increases sufficiently to feed gas into the sales line, the gas discharge valve will open. When the differential pressure between the casing and tubing indicates an accumulation of fluid in the tubing and sufficient casing pressure is available to discharge the fluid, the fluid production valve will open. A problem will occur with the Wynn controller if the discharge of gas into the sales line has been great enough to permit the plunger to raise to the surface before the opening of the fluid discharge valve. The plunger will not have sufficient time to fall below the fluids as the Wynn controller has no delay time between the closing of the gas discharge valve and the opening of the fluid discharge valve except for a limited valve speed adjustment.

It would be desirable to provide a programmable delay between the closing of the main production valve and the opening of the fluid bypass valve to insure plunger 'fallback'. The arrival of the plunger at the top of the tubing, in the Wynn controller, indicates that the fluid has been expelled and initiates closure of the fluid discharge valve and transfer of a downtime period. The fluid discharge valve may not be reopened until time out of the downtime period. If the discharge of the gas causes too great a pressure differential, indicating a maximum allowable fluid build up, or if the casing pressure falls below a preset limit, the gas discharge valve will close. The fluid discharge valve will also remain closed if the tubing pressure exceeds a maximum safe pressure for expulsion into the fluid storage tank. If during the open fluid discharge cycle, the plunger fails to arrive at the top of the tubing within a predetermined time, the fluid and gas discharge valves are both shut-in until the pressure differential between the casing and tubing again falls within the maximum allowable setting. A problem will occur with this production method if the plunger hangs up. When the plunger fails to arrive within the predetermined time during the open fluid cycle, the gas discharge and fluid valves are closed until the pressure equalizes through the fluid at which time the cycle is again initiated. Although the gas discharge valve will shortly close as the differential pressure exceeds the maximum, the fluid discharge valve will remain open for the duration of the predetermined uptime. As the tubing pressure will be lowered to atmospheric through the fluid discharge line, casing pressure will escape around the plunger and through the fluid to reduce the back pressure on the oil bearing formation and permit additional fluid accumulations. The well may soon load up beyond its capacity to discharge the fluids as the cycles continue. It would be desirable to prevent the accumulation of fluids using a programmable shut-in time to monitor the arrival of the plunger and initiate a total shut-in upon failure.

Another production problem occurs when the gas sales line pressure remains higher than the well's rock pressure for an extended period or when the well is shut-in to limit its gas production to the maximum allowable by the purchaser. It is most desirable to continue to produce oil under these conditions rather than lose both oil and gas sales. Although the Wynn controller incorporates time limits and provides for safety shut-in overriding, it must see a differential pressure between the casing and tubing to initiate the fluid valve opening. This differential is the result of fluids restricting the flow of gas from the casing, through the tubing, and into the gas sales line. If gas is not permitted to flow into the sales line, no differential pressure will be created and thus, the controller can not expel its fluids. The time cycle controllers are likewise limited under these conditions because gas flow is required through the production valve to provide enough pressure differential to raise the fluids.

It would be desirable to overcome this type of production problem by combining both time cycle functions and differential controller operations. A typical sequence of operation would be initiated when the casing pressure has increased to a programmed value indicating sufficient pressure to expel fluids. The main production valve, which feeds both oil and gas into a separator, opens and a maximum open time period is transferred to the systems clock. The plunger will normally soon arrive with the fluid slug and gas will continue to be discharged into the sales line until the accumulation of fluids in the tubing increases the casing/tubing differential pressure to its programmed limit. The main production valve is then shut-in and a plunger delay time is initiated to insure that the plunger has sufficient time to drop through the fluid to the bottom of the tubing before the production valve is reopened and the fluids discharged. In the event that the gas flow from the production valve is inhibited, a secondary sequence is initiated. The main production valve will be opened and maximum open time transferred as before upon sufficient casing pressure and at the end of any plunger delay time. The absence of sufficient gas flow to raise the plunger will cause the production valve to be closed at the completion of the maximum open time and the auxiliary bypass valve, which discharges directly into the fluid storage tank will be opened. The plunger will now arrive at the top of the tubing with the last of the fluid and cause the bypass valve to immediately close. The sequence then returns to normal with the transfer of plunger delay time. It would also be desirable to enter various safety pressure limits and time limits for more complete control.

The inclusion of an auxiliary bypass valve would also be desirable since it could serve as a fluid bypass in the time cycle mode of operation permitting production of oil and gas wells having low natural rock pressure. Such a bypass valve could also serve as the main production valve for the injection gas lift method of production.

U.S. Pat. No. 4,410,038 issued to Drapp describes an intermittent well controller which uses a main valve to supply additional pressure to the casing of a plunger lift well which has little natural rock pressure. The operation of the Drapp controller is basically that of a time cycle controller which will open a supply valve periodically to permit the injection of gas into the casing. The pressure of the injected gas is such that it will drive the plunger and the fluids to the surface. Upon the arrival of the plunger, the supply valve is shut-in and the plunger then drops again to the bottom of the tubing. The cycle may not be restarted until the completion of the selected cycle time.

Although the Drapp controller is based upon a type of low power microcomputer, its operator entry functions are severely limited to manual override and selection of number of cycles in a 24 hour period. The functions of the pressure limit switches are vague except for the maximum high casing pressure limit which will terminate the open supply valve cycle.

A major shortcoming with the Drapp controller is the assumption of a consistent high pressure source for injection upon initiation of the cycle and failure to provide cycle time modification by conditional inputs. If the available injection pressure source varies and causes only partial expulsion of the fluids or is insufficient for expulsion, loading of the well will occur due to continued fluid accumulation. The Drapp controller has no means of preventing continued fluid accumulations as it has no production control valve to restrict loss of tubing pressure. It would be desirable to use an injection supply valve and a production valve to prevent the accumulation of fluids by casing/tubing pressure equilization when insufficient injection source pressure is available.

The present invention contemplates a new and improved controller which overcomes all of the above referred to problems and others and meets the above stated needs to provide a new gas and oil well controller which is readily adaptable to a plurality of well operational uses with wells having a variety of operational characteristics and parameters, and which is easy to install, easy to operate, and which provides optimally improved well control and production.

BRIEF SUMMARY OF THE INVENTION

In accordance with the present invention, there is provided a gas and oil well controller particularly suited for regulating the flow of gas and fluids from a well to a gas sales line and the communication of well fluids to a storage tank. The new controller for a gas and oil well having a casing, a tubing, a gas sales line, a plunger lift device, and a production valve intermediate of the casing and sales line includes a microcomputer control circuit which is in operative communication with a casing pressure sensing means for sensing pressure in the casing, a tubing pressure sensing means for sensing pressure in the tubing, a line pressure sensing means for sensing pressure in the sales line, and a plunger lift device position sensing means for sensing the plunger lift device adjacent a top position in the tubing. The microcomputer has interface capabilities with both analog and digital peripheral sensing devices. The production valve is opened and closed in response to control signals from the microcomputer in response to well parameters sensed by the sensing devices bearing a predetermined relationship to preselected well parameter limits programmed in the computer memory.

In accordance with another aspect of the present invention, the microcomputer control circuitry delays control signals to the production valve for opening or closing the valve to avoid premature opening or closing due to the sensing of false readings, pressure surges or to expel accumulated fluids in the tubing.

In accordance with still another aspect of the present invention, an auxiliary production valve is provided in operative communication with the microcomputer control circuit to avoid well production to the sales line and to permit transmission directly to an oil and water storage tank. Such structure facilitates clearing the well of fluids when casing pressure is too low relative to sales line pressure and thereby unable to expel the fluids through the primary production valve. The microcomputer control circuitry senses casing pressure, sales line pressure, and plunger lift device position. When the casing pressure is so low relative to the sales line pressure as to be unable to urge the plunger lift device to the top of the tubing, the primary production valve will close the sales line to the well tubing and the auxiliary valve will open the tubing to the oil and water storage tank to allow the plunger lift device to move to the top of the tubing and expel fluids accumulated above the plunger.

In accordance with yet another aspect of the present invention, the microcomputer control circuit includes manually programmable switch means for programming selected control signals representative of preselected well parameter limits such as high and low pressure limits, time windows for well operation and production valve opening and closing delays. The microcomputer includes a memory for storing the preselected control signals and a display for displaying the control signals, well operating parameters, production characteristics and production performances to an operator.

In accordance with a further aspect of the present invention, the microcomputer control circuit includes a tubing pressure sensor for sensing pressure in the well tubing upstream from the main production valve. Preferably, the circuit also includes a plunger hold means for holding the plunger adjacent a top position in the tubing.

One benefit obtained by the use of the present invention is a gas and oil well controller which is primarily function specific in its operating control as opposed to prior controls which were more device or time specific. The controller maximizes well production and efficiency by maintaining essentially continuous observation of all salient well operating parameters and opens and closes the well to a sales line as those parameters suggest.

Another benefit obtained from the present invention is a well controller which has both analog and digital capabilities for interface with a variety of well sensing and peripheral devices such as a casing pressure sensor, a tubing pressure sensor, a sales line pressure sensor, and a plunger sensor.

A further benefit of the present invention is a controller which can effect delays in well opening or closing despite the sensing of parameters so indicating to avoid premature opening or closing where false readings, surges, or unexpelled fluid accumulations are present.

Yet another benefit of the present invention is a controller having manually programmable key pad switch means for entering well control parameters and having a display for convenient and easy control and readout by and to an operator of well operating limits, conditions and performance.

Still another benefit of the present invention is the provision of a plunger holding means which greatly simplifies the inspection and servicing of a well plunger.

Yet another benefit of the present invention is the provision of a controller which permits a record to be kept of well production and overall performance without additional equipment.

An additional benefit of the present invention is the provision of a controller which enables a well to be operated in the casing injection mode.

Other benefits and advantages of the present invention will become apparent to those skilled in the art upon a reading and understanding of this specification.

BRIEF DESCRIPTION OF THE DRAWINGS

The invention may take physical form in various parts and arrangements of parts, the preferred embodiments of which will be described in detail in this specification and illustrated in the accompanying drawings which form a part hereof and wherein:

FIG. 2 is a functional block diagrammatic schematic showing a control system formed in accordance with the present invention;

DETAILED DESCRIPTION OF THE INVENTION

Figure 1:
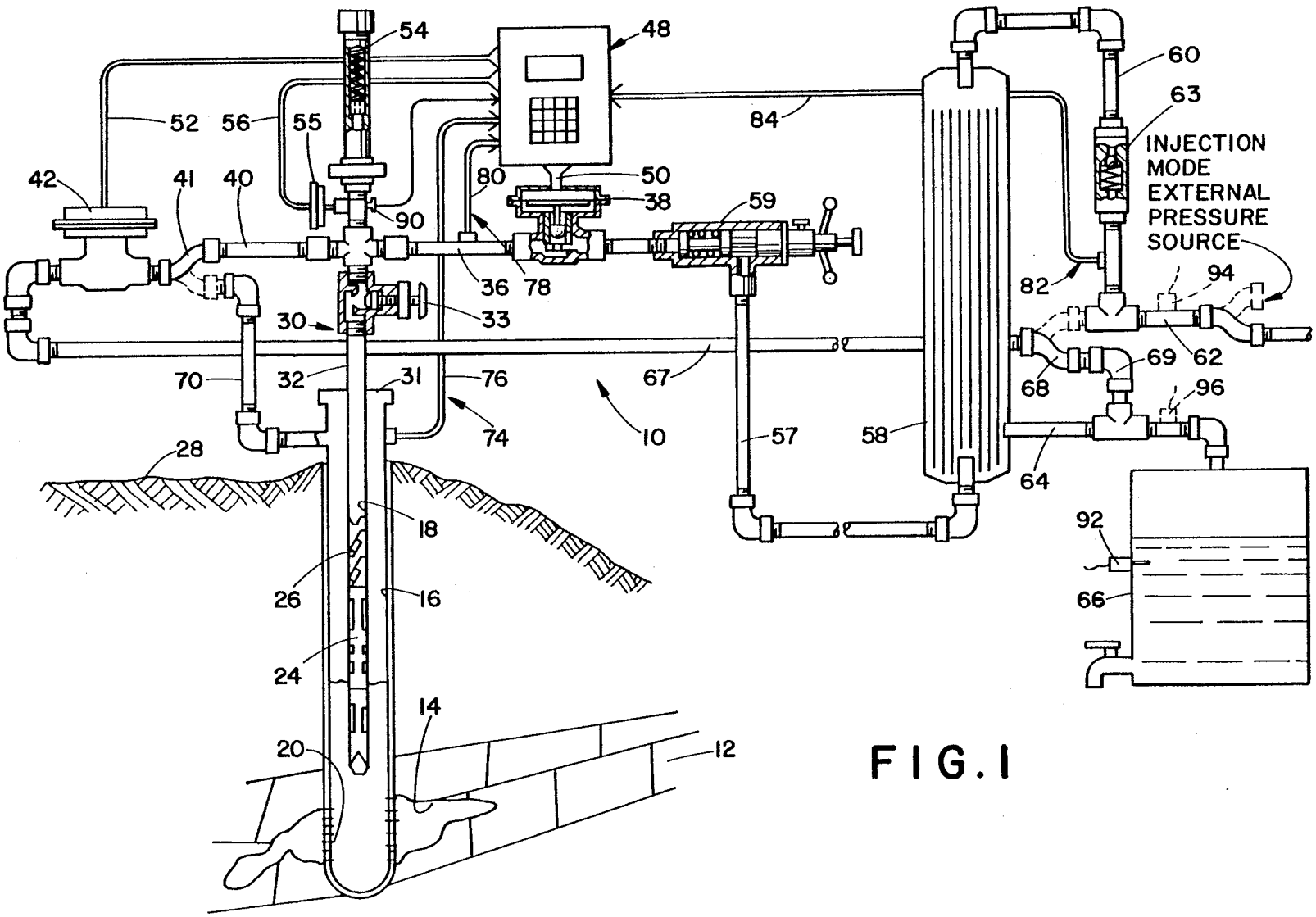
FIG. 1 is a sectional schematic view of a gas and oil well installation formed in accordance with the present invention showing its components sectionally and out of scale.

Referring now to the drawings wherein the showings are for purposes of illustrating the preferred embodiments of the invention only and not for purposes of limiting same, the FIGURES show a gas and oil well installation including a controller for controlling the flow of product from the well. More specifically, and with reference to FIG. 1, the well installation 10 is constructed at an oil and gas bearing formation 12 including a fracture 14 communicating oil, water and gas to a well casing 16 and a tubing 18 contained therein through casing perforations 20. The installation of the well casing and tubing is accomplished by well known and conventional well drilling and installation techniques. The tubing includes a plunger lift device 24 to facilitate the removal of fluids 26 such as oil and water accumulated above the plunger lift device from the tubing 18. The construction and operation of plunger lift devices are also well known in the art (see U.S. Pat. No. 4,150,721).

The casing and tubing extend from the formation 12 to above the ground level 28 toward the tubing top portion 30 which extends from the casing 16 and is sealed into the casing with a conventional sealing cap 31. The tubing top portion 30 includes a first tubing section 32 which has positioned therein an on-off valve 33. The top portion further includes a first tubing conduit 36 leading to a first production valve 38 and a second tubing conduit 40 leading through an elbow joint 41 to an auxiliary production valve 42. The first and second tubing conduits 36, 40 are in fluid communication with the first section 32 and can extend oppositely therefrom as illustrated. Valves 38, 42 are conventional gas and oil well production valves which are opened and closed by a controller 48 in operative communication with them through respective communication lines 50, 52.

The tubing top portion 30 also includes a lubricator 54 configured to receive and lubricate the plunger 24, as it is urged to a position adjacent the top of the tubing, to facilitate ease of movement for the plunger as it is cycled up and down in the tubing 18. Provided adjacent the lubricator 54 is a means for holding the plunger at the top of the tubing. In the embodiment shown, the means is a control valve 55 which is connected by a communication line 56 with the controller 48. The holding means is advantageous for greatly simplifying the inspection and servicing of the plunger by holding it in the lubricator 54 at the top of the tubing 32. The plunger is usually held after a specified number of cycles.

Downstream from production valve 38 is a third conduit section 57 which communicates well product to a separator 58 for separating oil and water from the gas component of the product. A variable choke 59 is preferably provided in the third conduit section 57 to control the flow rate through the conduit. Gas is communicated from the separator 58 through a fourth conduit section 60 to a gas sales line 62. Preferably, a sales line check valve 63 is provided in the fourth conduit to prevent reverse flow of gas when sales line pressure is greater than well pressure.

Oil and water are communicated from the separator 58 through a fifth conduit section 64 to an oil and water storage tank or battery of tanks 66. The auxiliary production valve 42 is also in direct communication with storage tank 66 through a sixth conduit section 67, an elbow joint 68 and a tubing section 69 which leads to the fifth conduit section 64 for the transmission of oil and water to the tank according to the method as will be hereinafter more fully explained.

A lift gas, when using the casing injection method, can be introduced from an external pressure source through line 62, the elbow joint 68, when in the position shown in dotted outline in FIG. 1, the tubing 67, through the 'B' valve 42, the elbow joint 41, when in the position shown in dotted outline, and a conduit section 70 into the casing 16 as will be described hereinafter. Naturally, whichever conduits the elbow joints 41, 68 are disconnected from, are closed off.

The varying well operating characteristics incidental to any gas and oil well are observed according to the present invention by a number of sensing devices. With continued reference to FIG. 1, the sensing devices include a casing pressure sensor means 74 comprised of a conventional pressure sensing device which senses a parameter directly related to and representing the pressure in the well casing. The parameter is communicated to the controller 48 through a casing read line 76 in operative communication with the controller 48. A tubing pressure sensor means 78 senses the pressure in the first tubing conduit 36 upstream of the first valve 38. The sensor means 78 communicates with the controller 48 through a read line 80. Tubing sales line pressure in conduit 60 is detected through a tubing sensor means 82 and is likewise communicated to the controller 48 through a read line 84. As will be described hereinbelow, the sensor means 74, 78, 82 can be transducers located in the housing of the controller 48 and communicating with the respective casing tubing sections through the respective read lines 76, 80, 84. It should, however, be recognized that other conventional types of sensor means, which may be located either in the controller box or in the respective lines, for sensing these pressures could also be utilized.

A plunger sensor 90 is included in the tubing top portion to detect when the plunger lift device 24 has been urged to the top of the tubing through pressure in the casing 16.

A temperature sensor 92 can be provided in the oil and water storage tank 66 to detect the temperature of the tank 66 and communicate a parameter indicating the temperature to the controller 48 through a read line (not shown). The controller has the capability to shut in a supply valve (not illustrated) used to provide a heating means for the storage tank which is necessary for more complete separation of oil and water prior to shipment. It is within the scope of the invention to include other known types of well installation sensors and detecting devices such as an oil and water storage tank fluid level indicator to indicate a full tank, separator sensors to indicate separator conditions and other similar types of sensing devices.

Additionally, a flow sensor 94 can be placed in the gas sales line 62 to measure the flow of gas therethrough if desired. A similar flow sensor 96 can be positioned in the fifth conduit section 64 to measure fluid flow therethrough if desired.

With reference now to FIG. 2, a functional block diagrammatic of a schematic controller formed in accordance with the present invention is illustrated. The control system is configured around a low power CMOS microcomputer 100. The microcomputer 100 can be of the 63701xo, 63705, or 146805 type. These microcomputers offer sufficient ports with internal memory, timers, and communications circuitry to minimize the size, power, and complexity of the device. The basic operating frequency is set by the selection of a crystal 102 which is used by the microcomputer's internal clock circuitry. All system functions are programmed in a low power non-volatile memory 104, such as a 32K word log memory, which may be removed and exchanged to provide special functions and options as required in accordance with particular operating parameters of the well. One such memory is a CMOS static RAM such as an HM62256. This provides enough storage for over 2000 data messages of 16 words each. Each data message can include time, system status, current pressure readings, volumetric values, and plunger information. A standby power source 105 for the memory 104, such as a lithium battery, can also be provided.

The time base for the system is a real time clock 106 which provides log time information and "wakes up" the microcomputer from a "sleep" or low power standby mode once every time period, (e.g. once a second). All registers, timers and functions will then be updated within a fraction of a second and the microcomputer will return to the "sleep" mode to conserve power. The real time clock's time keeping operation is maintained in the event of a system power shut-in by the independent power source 105 used for the log memory 104. When the system is returned to power, the real time is used to update the system dependent clocks and timers.

An independent "watchdog" timing circuit 108, which can be designed from a 4528 dual precision timer, provides system failure detection by initiating a system restart and direct shut-in override to the production valve if it is not reset once each second during the normal program sequence. The timing circuit will close all control valves and reset the microcomputer 100 in the event of program failure or control system malfunction.

A communications port 110 is controlled by the internal communications circuitry of the microcomputer 100. Security access codes and commands are all accepted through the communications port and all data and output messages are transmitted using ASCII (American Standard Code for Information Interchange). The power supply may consist of a storage battery 112. An external solar panel 114 or a portable recharge power pack (not shown) can be used for recharging the battery. Alternately, discardable dry cells can be used for the battery 112.

It is a feature of the invention that the controller 48 consumes a minimum amount of power in operation. To further facilitate a capability for lengthy unsupervised operation, the solar panel 114 can be employed to supply power to the controller and its battery 112.

Operator commands can be entered through a weather-proof 4×4 or 4×5 matrix key pad 120. The microcomputer 100 will debounce and decode the key entries into an equivalent ASCII code for use by the systems program. Most commands require two or three entries and numeric data is entered as prompted by the display.

The system display is preferably a one or two line LCD alphanumeric display module 132 such as the H2570 or LM052 self contained display modules capable of displaying both upper and lower case letters, numbers and special characters. Such modules accept ASCII code input and commands from the microcomputer and perform all necessary data storage and refresh functions internally. The display 132 indicates status, time and pressure parameters as will hereinafter be more fully explained.

An expandable output buffer 134 is included in the preferred configuration for control of up to four independent control valves. The buffer circuit terminates with a low input darlington or mosfet power driver which enables either an open coil or close coil of a pulse type, two position pneumatic control valve 135–138. The pneumatic valve can be similar to the VALCOR 54P193 series or the CLIPPARD EV3M/R302 series. Available well gas pressure, regulated by a WILKERSON R10-02 or equivalent regulator, is used by the pneumatic valve to open or close a large production control valve, such as TELEDYNE MB40 or KIMRAY 2200SMT type (FIG. 1, 38, 42). The plunger catching device (FIG. 1, 55) uses a similar pneumatic valve arrangement to move a "trap pin" into the tubing below the plunger when it is in the lubricator (FIG. 1, 54).

An expandable input gate 140 is included to enable immediate response to input signals from various sources. Typical switch inputs comprise a plunger lift sensor 90 and various safety sensors which may also indicate system component failure. One such sensor could be a safety input 143 such as a limit switch which would indicate that the oil and water storage tank is full. Another input could be a safety switch that would indicate the failure of an installation component such as a valve which could be an optional input 144 or 145, as shown. It should be noted that any switch closure, including a key on the matrix key pad 120, will "wake up" the microcomputer 100 for immediate service of the switching device. The gate 140 can be directed to sense or ignore any of the inputs and to cause an "interrupt" which will require an immediate response.

An analog subsystem 146 (Motorola 14443) provides the greatest portion of incoming data. It is a six input analog to pulse width converter which is isolated from the main power and provides a precision reference voltage 147 for the transducers 74, 78, 82.

The passive analog devices can comprise such installation components as pressure transducers 74, 78, 82, flow rate transducers 94, 96, temperature probes, tank level indicators and battery voltage monitors. These devices are monitored to ultimately control the production control valve. It is a particular feature of the invention that active control of the production valve can be delayed such as for a program limit delay to limit opening the well against a premature opening, or such as for a program purge delay to delay closing the well to avoid premature shutting-in.

Control of the subsystem by the microcomputer results in an analog to digital converter capable of greater than 16 bit resolution. An analog input may be resolved into more than 65,000 parts. An example of the usefulness of this data would be the measurement of the casing pressure using a VERNITECH 9000 series or NEI P200 series pressure transducer. If the transducer is rated even as large as 4000 PSI full range, the output may be resolved to 0.1 PSI. This measurement, with the tubing and line measurements, provide very high accuracy in determining differential and flow rate calculations.

One input of the analog subsystem is used to monitor the systems power supply 112. The power supply can, as mentioned, consist of a rechargable storage battery and an external solar panel 114 or discardable dry cells. The analog input permits direct supply voltage readout and low battery warning.

It is another feature of the invention that internal circuitry and peripheral devices not required for immediate functions are shut down by the system to conserve power. The system is expandable through a device select and decode circuit (not illustrated) to include additional functions. All components for the gas well controller circuit shown in FIG. 2 comprise well known commercially available elements.

Figure 3B:
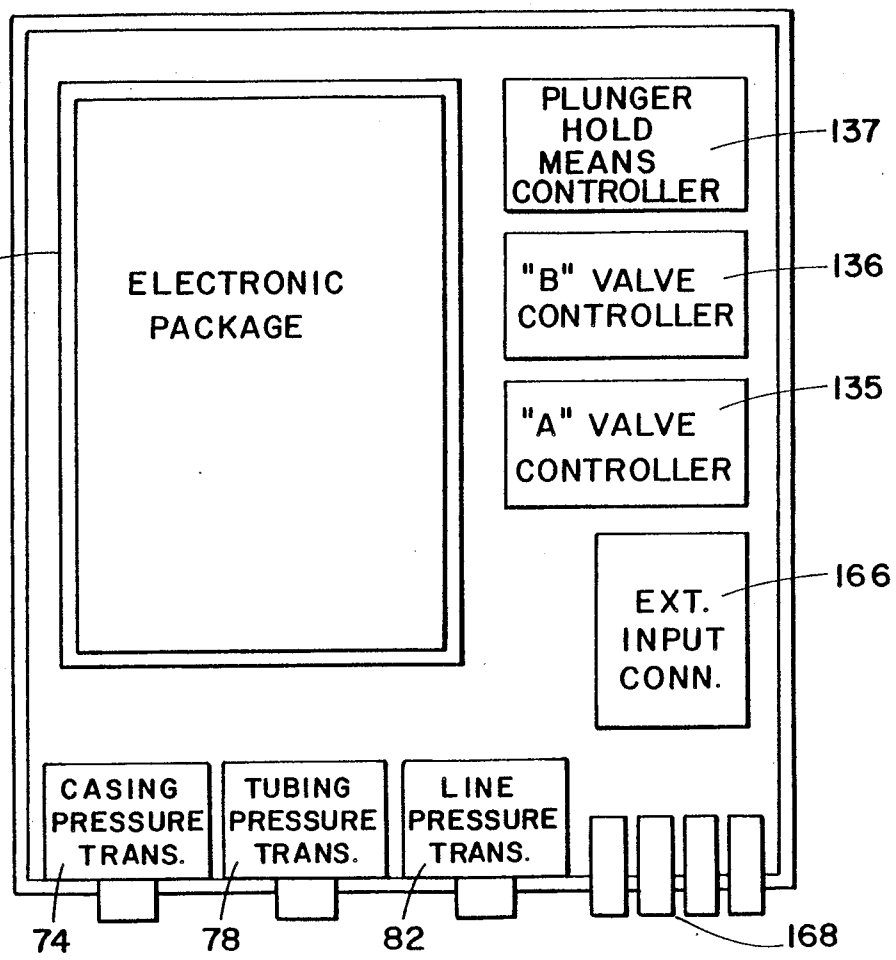
FIG. 3B is a schematic rear elevational view of the controller of FIG. 3A.
Figure 3A:
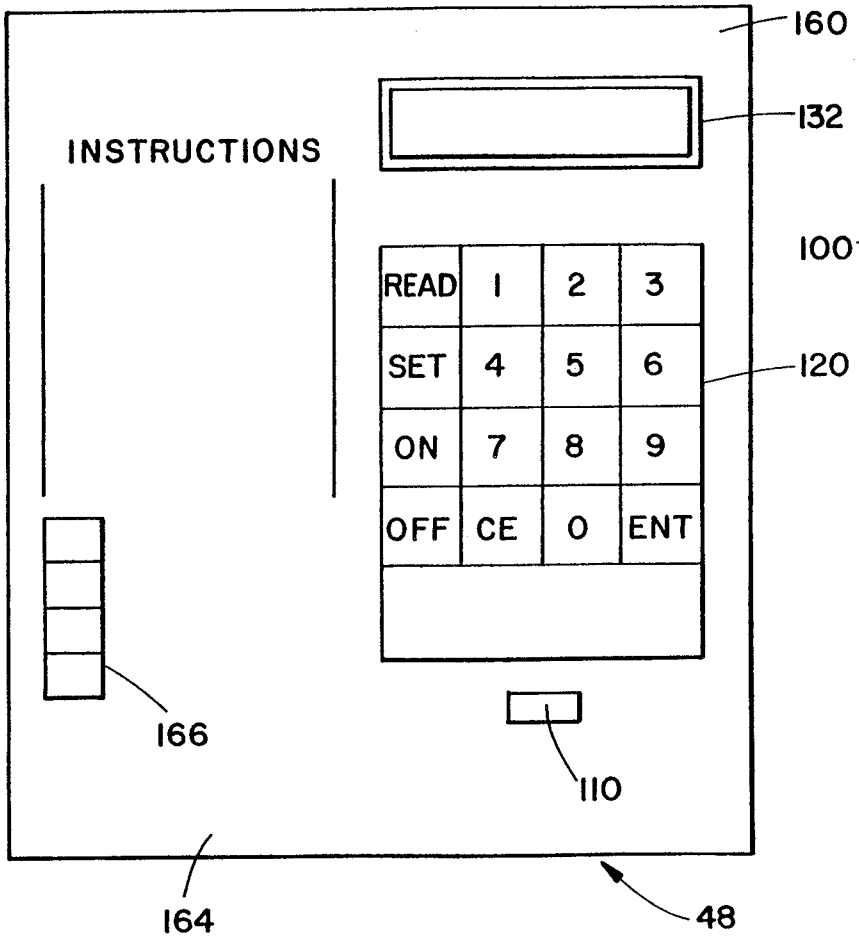
FIG. 3A is a schematic front elevational view of a controller according to the present invention.

The physical configuration of the controller 48 is shown in FIGS. 3A and 3B. The control package is usually enclosed in a weather proof or explosion proof box 160 which can be approximately 8" wide by 10" high and 5" deep.

The keypad 120, display 132, and the communications port 110 are located on the right side of a face plate 164. Operating instructions are printed on the left side of the faceplate above an external input connector 166.

Looking at the faceplate from the rear view, the electronic package 100 is located to the left above the casing pressure transducer 74, the tubing pressure transducer 78, and the line pressure transducer 82.

A series of pressure fittings 168 are located at the bottom to right for connection of the 'A' valve controller 135, the 'B' valve controller 136, and the plunger hold means controller 137 which are all mounted thereabove.

The block at the lower right is the external input connector 166 which also incorporates signal conditioners and the drivers for the control valves.

The rechargeable battery 112 (FIG. 2) which is most often used as the main power source is usually mounted to the enclosure behind the electronic package. The inputs from the external solar panel 114 are connected to the battery through the external input connector 166.

The control and operative sequence for a controller formed in accordance with the present invention is illustrated in FIGS. 4–7. Before discussing these figures, it is necessary to understand the general operation of the controller.

The controller was primarily developed to fill the need for a highly accurate and flexible control system to optimize production of a "plunger lift" type equipped oil or gas well. The controller continuously monitors the casing pressure and the line pressure through analog pressure transducers. The primary or "A" valve 38 (FIG. 1) may be programmed to open when the casing pressure builds to a specified value and close upon arrival of the fluid plunger 24 adjacent the plunger sensor 90 or when the casing pressure falls to a specified value.

The controller may also be programmed to close the "A" valve 38 if the line pressure exceeds a specified value permitting maximum "sale" to a single line from a number of individual producing gas wells. A low line limit may be programmed to close the valve 38 if the line pressure drops too low, indicating a break in the line.

With the input and output devices selected in the preferred configuration (reference FIG. 1), the method of control of an oil and gas well may be selected by the producer without additional equipment. The common methods of well production include simple open/close timers, simple casing/tubing differential controllers, combination timer/differential controllers, and injection well controllers. The placement of the three analog pressure transducers, casing 74, tubing 78, and line 82, provide input data for comparison with high and low pressure limits and calculation of differential pressures and flow rate.

The auxiliary or "B" control valve 42, in addition to the standard or "A" production control valve 38, provides a path for discharge of fluids directly to the storage tank 66 or for the introduction of lift gas when used with the injection well method. The variable choke 59 is also standard to restrict the flow of gas into the separator 58 and prevent the plunger 24 from surfacing at too great a velocity into the lubricator 54 if the production valve 38 is opened on high casing pressure and little fluids. The plunger arrival sensor 90 is mounted below the lubricator 54 to signal the passage of the plunger 24 into the lubricator cushion spring.

The method which the producer may determine best for any particular well, thus becomes a selection of the various options offered by the system and the entry of perimeter data and line limits. The present invention performs all of the functions of all of the previous controllers and provides the operator with more programmable inputs to provide a mix of control methodology not previously attainable with any single system.

If it is desirable to produce a well using the time cycle mode of operation, the close time window and open time window entries are first set to define the constant cycle times. If the well has low casing pressure or volume or if it is discharging into a relatively high pressure sales line, the 'B' valve time may be entered to provide a means of fluid bypass. If the casing volume is low, the shut-in time may be entered to permit casing pressure recovery upon failure to discharge fluids. The low casing pressure limit should also be set to limit loss of rock pressure during production. The limit delay time should be entered to prevent premature termination of the production cycle with pressure fluctuations during the passage of the fluid slug. The low line limit may also be entered as an additional safety to prevent production discharge into a broken or leaking line. If purge time is desirable to sell additional gas after the discharge fluids a purge delay time can be entered. A high line limit may be set if it is desirable to suspend production during a period of high sales line pressure.

The open sequence begins when the open time window is transferred. The 'A' or main production valve will open if no safety or close pressure limits are active. In a plunger lift well, when the main production valve 38 is opened, the tubing pressure will drop to that of the sales line and the higher casing pressure will cause the plunger 24 to move upward pushing a slug of the fluid with it. When the plunger arrives at the top of the tubing, the fluid production cycle is complete. If a purge delay has been entered, the 'A' main production valve 38 will not close as it normally would upon plunger arrival until time out of the purge delay. Then the 'A' valve will close and the plunger 24 will drop to the bottom of the tubing. The cycle may not be restarted until time out of the remainder of open time window and the time out of the close time window, which is transferred upon time out of the open time window.

If during the open time window in which the 'A' valve 38 was open, the plunger does not arrive before time out of the open time window or before the low casing pressure limit becomes active, any 'B' valve time entered will become active. The 'A' main production valve will close and the 'B' bypass valve will be opened to attempt to discharge the fluids directly from the tubing to the fluid storage tank. When the 'B' bypass valve 42 is active, the plunger arrival will terminate the cycle and the sequence will return to the current time window mode.

If no 'B' valve time was entered or if an active 'B' valve times out before the plunger arrival, any shut-in time entered will become active and hold the well in a shut-in mode for the duration of its time. A secondary time sequence does not affect the count of the constant time windows. This permits production synchronization of several wells, each operating within a specific time period, into a common line.

If during the production cycle when either the 'A' main production valve or 'B' bypass valve was open, the high and low line limit becomes active or a safety input is present, the 'A' or 'B' valve will temporarily close until the line pressure returns within the limits or the safety is no longer active. A safety input is an input from any type of switch or sensor which is placed on a peripheral device or attachment to indicate the necessity of the well to remain shut-in for the duration of the active signal.

Several wells are often connected to a single pay line and it may become necessary to sequence their respective start times for maximum production. The controller permits the programming of an open start time and a close time in which production is inhibited. Accordingly, even where casing pressure is so high as to indicate the well could be opened, the controller will not permit opening unless the well is within a time window in which it can be opened.

The controller will also check for the presence of user program limits, delays, or times and select the function or sequence required to optimize production from a decision algorithm. The production may be controlled by pressure only, time only, or any combination of the two in accordance with the plunger arrival sensor and preselected delay times.

If it is desirable to initiate the production when the casing pressure has increased to a specific value, the high casing limit may be entered. This limit may be used with all previous time and limit entries as its purpose is to terminate the remainder of the close time window and transfer the open time window to initiate the production cycle. A plunger delay time should be used with this function to delay the restart of the production cycle allowing the plunger 24 sufficient time to return to the bottom of the tubing. The high casing limit function will override the constant time cycle.

If one or more wells are connected to a user's gas supply line, as in company owned wells, the low line open option may be selected. The low line option will initiate the production cycle as does the high casing limit. When used with the open and close time windows and the 'B' valve bypass time, the unique feature permits user-owned wells to maintain a desired gas pressure in the user's line and insure the removal of fluids which may restrict the natural gas flow.

An off or close differential limit may be used with any or all of the previous entries to terminate the open 'A' main production valve sequence. The differential pressure between the casing and tubing will indicate an accumulation of fluids in the tubing. If a 'B' valve time has been entered to enable the bypass valve operation, the 'A' valve 38 will close on the off differential limit. After a delay time equal to the purge delay entry, the 'B' valve 42 will open and sequence as described previously. If no 'B' valve time is entered, the plunger 24 must have arrived at the top of the tubing during the open 'A' valve cycle before the off differential limit is recognized. This insures that the fluids present at the initialization of the 'A' valve open sequence have been expelled and prevents premature termination due to fluctuating pressures with the passage of the fluid slug.

If the off differential limit is entered and a low casing limit becomes active during the open 'A' valve cycle, the production cycle will be terminated and the 'B' bypass cycle will remain inactive to prevent a "dry" plunger cycle and permit the casing pressure to build.

With the high casing limit and the off differential limt, the system functions as an enhanced differential mode controller. The time and pressure limits are adjusted for optimum performance. If the production is mostly fluids, the open or on differential limit may be entered to further modify the initiation of the production cycle. This limit will inhibit the start sequence until the casing and tubing pressures have equalized to a desired value and the casing pressure is sufficient to discharge the fluids. This feature is primarily used when the available rock gas volume is low.

If the well has insufficient casing pressure to produce its fluids, it is desirable to operate in the casing injection mode in which the auxiliary valve 42 becomes the supply injection source valve and the main valve 38 becomes the production valve. The cycle times must be set by entry of the close time window and the open time window. The high casing limit must be entered to permit initiation of the production cycle when sufficient casing pressure is present. The main valve time must be entered to set the maximum allowable open time of the production valve. The low casing limit must be set to terminate the open production time if the casing pressure drops below a specific value. A limit delay should be entered to smooth the pressure fluctuations during the production of the fluids. A purge delay may be entered if it is desirable to purge all fluids from the line after plunger arrival. High or low line limits may be entered if additional safety or control of production into a common line is required.

The sequence of operation for the present invention in the injection well mode begins with the opening of the injection supply valve 42 after the time out of a programmable minimum close time. The injection valve 42 will remain open until the casing pressure increases sufficiently to expel the fluids or until the termination of the cycle by a programmed maximum open injection time. When sufficient casing pressure is avaiable, the injection supply valve 42 will close and the production valve 38 will then open. The production valve 38 may be closed and the sequence terminated by the time out of a programmable maximum open production time or if the casing pressure falls below a programmable low pressure setting. If the production sequence was terminated by insufficient casing pressure, additional fluid accumulation will be inhibited by the relatively higher pressure remaining in the casing and tubing. If the plunger 24 arrives with the fluid before termination, a programmable purge delay time may become active to purge the fluids from the line and return the tubing and casing pressure to the natural rock pressure for the promotion of additional fluids. Upon termination of the sequence, a programmable minimum close time is transferred to the system clock to permit the return of the plunger 24 to the bottom of the tubing 18 and allow sufficient time for the accumulation of fluids. The additional pressure, safety, and time limits which may be programmed for use in this mode are detailed hereinbelow.

The injection sequence begins upon time out of the close time window when the open time window is transferred and the injection source valve 42 is opened. The casing pressure will increase to the high casing limit which initiates the production cycle. The injection valve 42 will close and the production valve 38 will open with the transfer of the production valve open time. The pressure in the tubing 32 will drop to that of the production line and the casing pressure will lift the plunger 24 with the fluid to the surface 28. After the discharge of the fluids, the plunger arrival will cause the purge delay (if any) to be initiated. After plunger arrival or time out of the purge delay, the production valve 38 is closed and the close time window is transferred. The production cycle may not start again until the time out of the close time period.

If during the open sequence of the injection valve 38, the casing pressure did not increase to the high casing limit before the time out of the open time window, the cycle would have been terminated and the close time window transferred to the system clock. This would permit recovery of the injection supply source through pipe 62.

If during the open sequence of the production valve 42, the plunger 24 did not arrive before time out of the production valve time, the cycle would be terminated and the close time window transferred.

If the high or low line limits become active or safety input is active during the open sequence of either 'A' 38 or 'B' 42 valves, the valve will be temporarily closed until the line pressure returns to within the limits or the safety input is no longer active.

A unique feature of the present invention is the summation of total gas sales and gross fluid production for the well. After initial calibration, no additional transducers or peripheral devices are required.

The total gas sales value is an accumulation of flow rate/min. The flow rate in CFM is calculated by the formula $Q = \text{Constant} \times \text{SQRT}(DP \times SP)$ where $DP$ = tube pressure - line pressure, $SP$ = static tubing pressure, and Constant is a value entered by the operator to adjust the volumetric flow calculations. Although the factors which determine the Constant are quite complex, an unskilled operator may easily perform the calibration procedure. The value form the non-calibrated flow rate calculation is summed each minute using a default value for Constant. A gas flow meter is connected to the sales line and the actual volume of gas discharged for a specific period is entered as the calibration factor. The system will compare the total non-calibrated volume for the same period and extract a Constant which will adjust the calculated value to actual. This Constant is then placed in nonvolatile memory for use in all future flow rate calculations.

The gross fluid production is calculated as ((casing pressure - tubing pressure) Constant/sec) × Time, where Time is the total period from the opening of the fluid discharge valve until the arrival of the plunger after fluid passage. The Constant is a value which adjusts the calculated fluid valume to actual volume. The Constant is extracted by the system during the fluid calibration procedure in which an observed actual fluid production for a specific period of time is entered as the fluid calibration factor. The system will compare the actual with the non-calibrated total for the same specific period and calculate a Constant which is then placed in nonvolatile memory for all future fluid volume calculations. The formula is unique in that its accuracy is maintained by the operational functions of the controller. Upon the opening of the main production valve, the tubing pressure will lower until it equals the sales line pressure. The pressure difference between the tubing and the casing then is a result of the fluid accumulation.

The casing/tubing differential pressure will then change as the fluid slug is lifted and discharged. A value is calculated and accumulated each second until the plunger arrives. Although the actual accuracy of the calculated value will vary throughout the time period, the average or total accumulated value will fairly represent the actual total volume of fluids discharged. If the sales line pressure increases to inhibit the discharge of fluids, the 'B' bypass valve is used, the values which may have erroneously accumulated during the open time of the 'A' main production vale will be reset and the flow calculations will begin again as the 'B' time pressure limits, the accumulated value will be discarded. If the producer desires to sell only gas from the main production valve and fluids from the bypass valve, the 'A' valve time may be eliminated from the flow calculations during the calibration procedure as an option entry in response to a prompt on the display.

Another unique feature of the present invention is the storage of various current values prefixed by a real time code indicating day, hour, minute, and second. The preferred configuration includes, but is not limited to, a non volatile memory capable of storing 2048 messages of 16 words each. This LOG feature has two optional formats for the message string. This first includes real time, status, casing psi, line psi, total fluid volume, total gas volume and total cycle count. The second is used for performance analyses on set-up and includes real time, status, casing psi, tubing psi, line psi, total open time, and cycle count. The LOG sampling rate is programmable by the operator as LOG delay time in hours, minutes, and seconds. If no LOG delay time is entered, the LOG will be updated with each system status change; that is, with a time or valve change or with a limit or external input. The LOG memory may also be selected to "wrap around" to the beginning or to "freeze" when full. The LOG data may be "dumped" upon command to an external or remote data storage device.

A special feature for plunger inspection and service has been included in the present invention. A device which consists of a gas operated diaphragm 55 moving a spring loaded pin, is attached just below the lubricator 54 to prevent the plunger 24 from dropping after arrival if it is actuated. Plunger inspection is necessary due to wear and the accumulation of solids and is normally accomplished by manually shutting in the well and removing or bypassing the gas pressure to permit retrieval of the plunger. The frequency of inspection varies with the well condition and the type of plunger. General types of plungers include capillary, turbulent seal, brush, expanding blade, wobble washer, and combinations of type which may also include integral valves or lubricator actuated valves. In certain areas, solids may be deposited on the tubing walls, which left unattennded would inhibit or prevent production. Plungers selected to cut and clean the deposits will wear quite rapidly and must be checked more often to maintain optimum performance. The present invention includes a programmable maximum cycle count which will trap and hold the plunger in the lubricator when the total plunger cycles is equal. The well will then be shut-in until it is serviced and restarted by an authorized operator. This drastically reduces the service time and permits and inspection schedule to be maintained.

All commands and functions performed by an operator at the keypad of the controller, may also be performed from a remote communications device (not illustrated) using the proper format and security codes. All values or readings which are displayed in the controller, may also be transmitted to a remote communcations device through the integral communications port (not illustrated).

With reference to FIGS. 7A–7I, the function control or main loop algorithm first will look at the various pressure limit flags, the status of inputs for safety and the preset control valve status. Included as subroutines in the function control section are an open limit test and closed limit tests illustrated in FIGS. 4 and 5.

Figure 4:
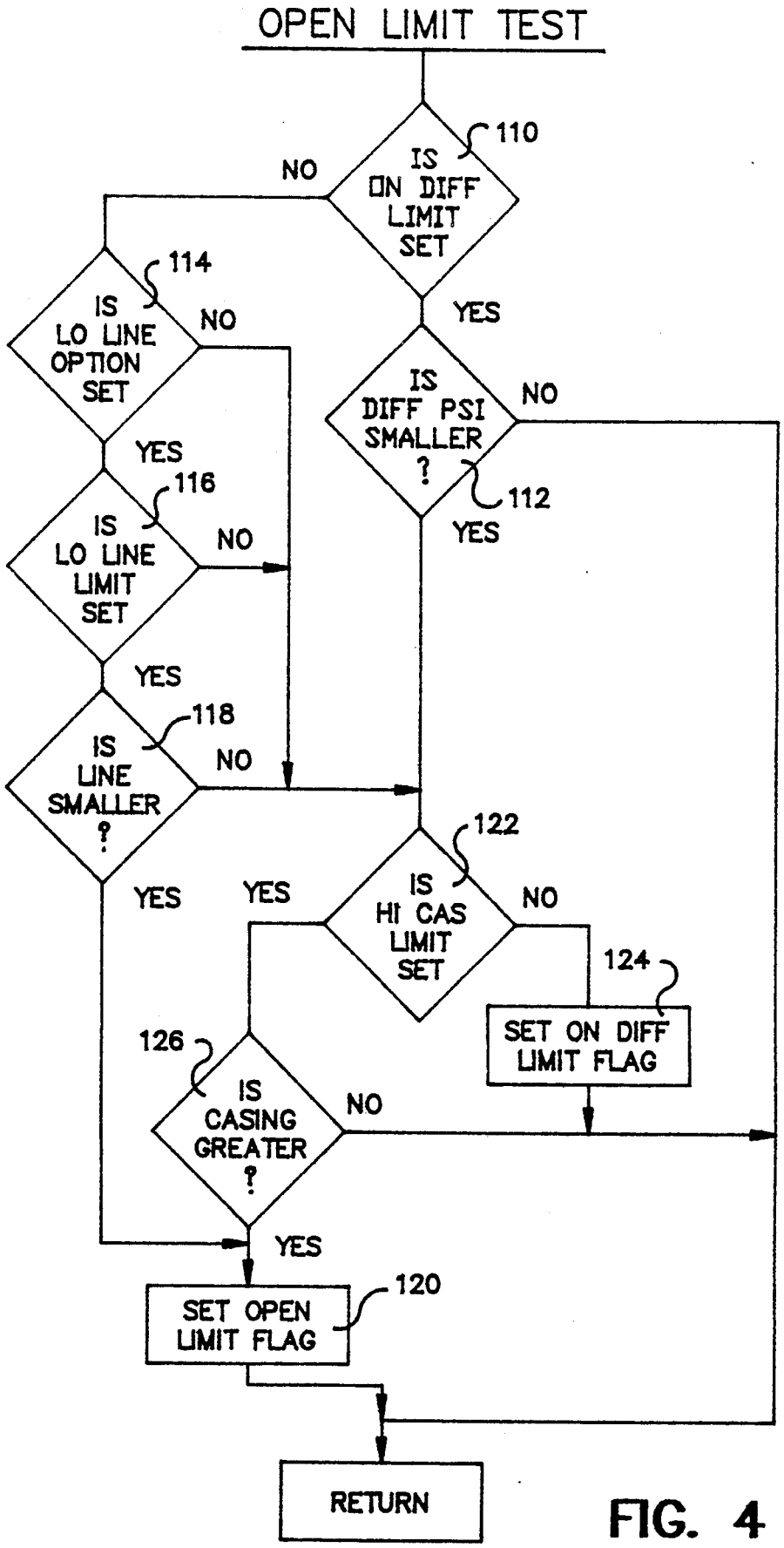
FIG. 4 is a flow chart diagrammatic schematic of an open limit test of the control system of FIG. 2.

With reference first to FIG. 4, the open limit test subroutine is there illustrated. This routine will compare the appropriate pressure meansurement with any open limit pressure entry and set limit flags to be used by the function control section of FIGS. 7A–7I. As this program is run, the controller first looks to see if the open differential limit has been set as shown in decision block 110. If so, a test is run to see if the casing tubing psi exceeds the limit, as shown in decision block 112. If it does not, the subroutine comes to an end. If the open differential limit has not been set, the subroutine checks to see whether the optional low line open flag has been set as shown in decision block 114. If so, the routine checks to see whether a low line limit has been entered as shown in decision block 116. If a low line limit has been set, then a test is run to see whether the line pressure is lower than the limit setting as shown in decision block 118. If the optional low line limit has been exceeded, then an open limit flag is set which will indicate a conditional open command as shown in block 120. The subroutine then comes to an end. On the other hand, if the open limit is not set by the low line option, or if the open differential has been exceeded, then the routine goes on to test to see if a high casing limit has been entered as shown in decision block 122. If no high casing limit is set, then the open differential limit flag is set which will indicate a conditional open command as shown in block 124 and the subroutine comes to an end. On the other hand, if the high casing limit is set then a test is run to see if the casing pressure is greater than the limit as shown in decision block 126. If not, the subroutine comes to an end. If it is, then the open limit flag is set as shown in block 120.

Figure 5:
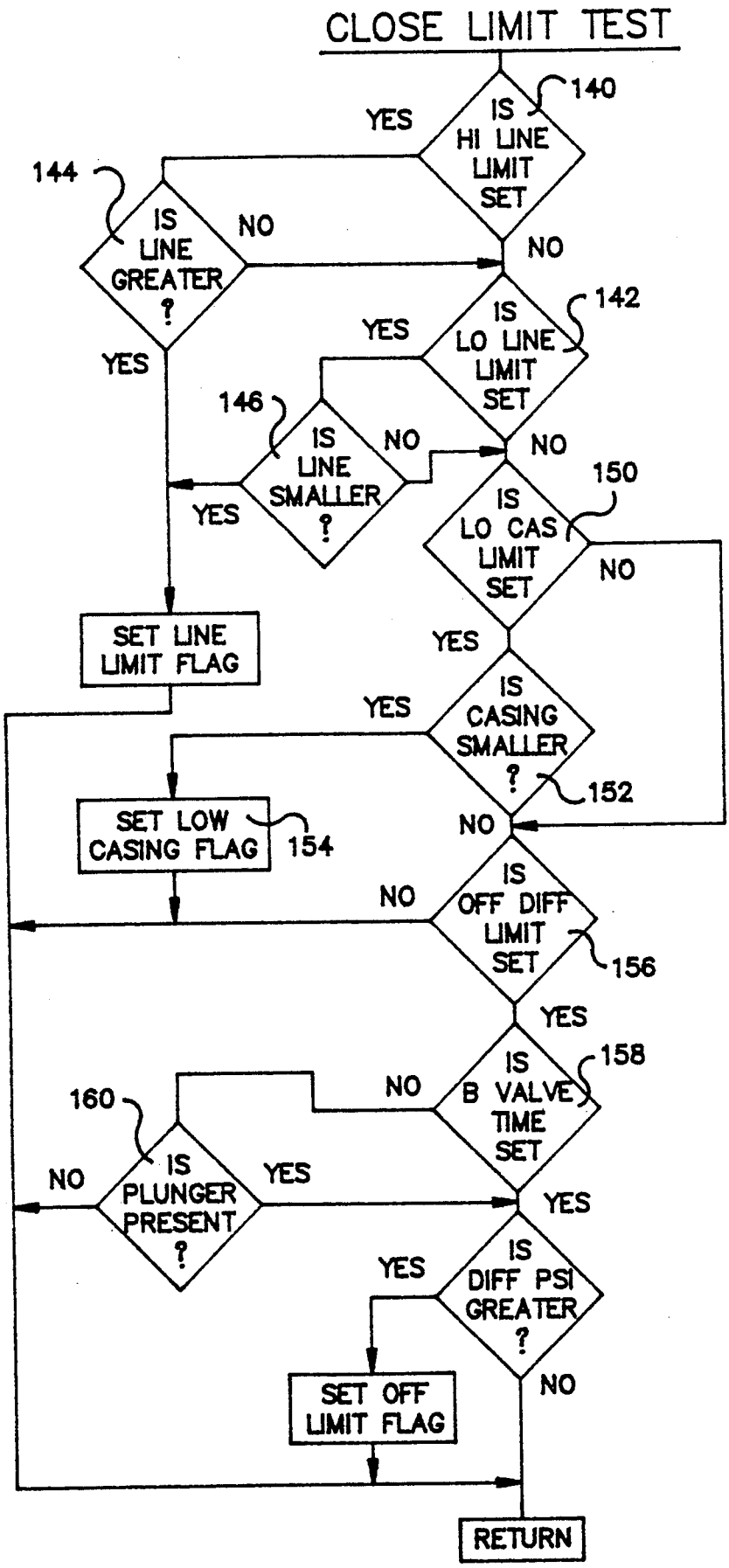
FIG. 5 is a flow chart diagrammatic schematic of a close limit test of the control system of FIG. 2.

With reference now to FIG. 5, the close limit test is there illustrated. This subroutine will check the appropriate pressure measurement with any close limit pressure entry, which is permissible at the time of the test, and determine if a limit flag of some type must be set for action by the function control system. First the routine checks whether a high line limit has been set by the operator as shown in decision block 140. If not, the routine checks whether a low line limit has been set by the operator as shown in decision block 142. If either of these limits has been set, a check is made to see whether the actual pressures have exceeded the limits set as shown in blocks 144, 146. If so, then a line limit flag will be set for temporary closure of the valves as shown in block 148 and the subroutine comes to an end. On the other hand, if the answer is no to both of these inquiries, then the subroutine goes on to check whether a low casing limit has been set by the operator as shown in decision block 150. If so, a check will be made to determine whether the actual casing psi is lower as shown in block 152. If it is, then the low casing flag is set as shown in block 154 and the subroutine comes to an end. If the casing limit has been exceeded, on the other hand, then a check is made to see whether the off differential limit has been set as shown in decision block 156. If no off differential limit has been set, and the casing limit has been exceeded, then the low casing limit flag is set for action by the function control section. If the off differential limit has been set, then the 'B' valve time presence will determine if the plunger must be present before the off differential limit is tested as shown in decision block 158. If the 'B' valve time has not been entered, then the plunger must be present at the sensor before the off limit tested as shown in decision block 160. If 'B' valve time has been entered, or if the plunger is present the subroutine checks to see whether the differential pressure is greater than allowed.

Figure 6:
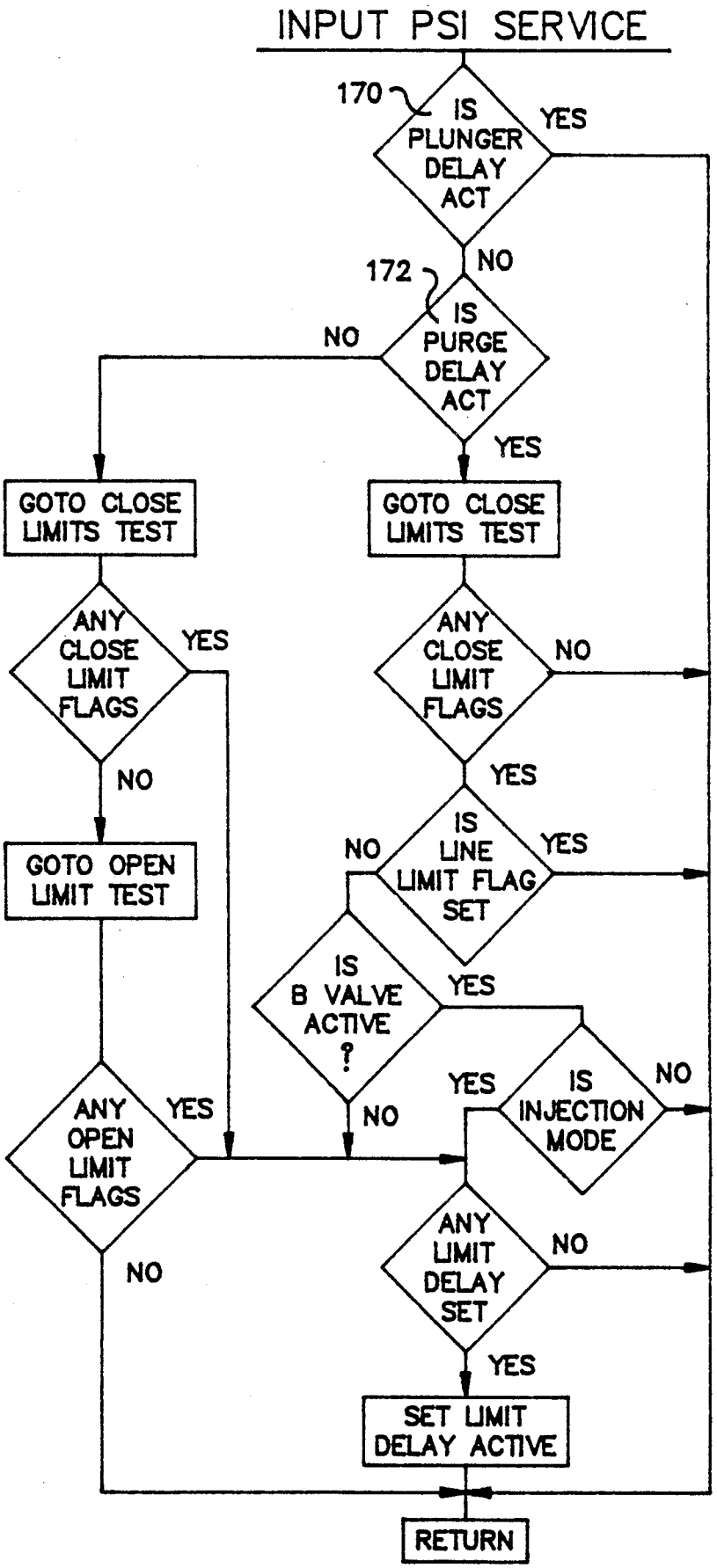
FIG. 6 is a flow chart diagrammatic schematic of an input psi service routine of the control system of FIG. 2; and, FIGS. 7A–7I are block diagrammatic schematics of the functioning of the control system of FIG. 2.

Another subroutine which utilizes the open limit and closed limit tests of FIGS. 4 and 5 is the input psi service subroutine of FIG. 6. This subroutine will determine which of the pressure limits to test at any time during the production cycle to reduce unnecessary operations. The subroutine will determine which analog inputs to read and will compare the readings with preset high and low limits. As shown in decision block 170, if the plunger delay is active, all other checks are bypassed. If it is not, then the purge delay is set when the plunger first arrives during the normal open mode of the 'A' valve as shown in decision block 172. A check is made during the purge for a line or a casing limit. A line limit will temporarily close the valves until the line psi is again within the preset limits. If purge is not active and no close limits are found then the subroutine will check the open limits. If the purge is active and a low casing or off differential limit is found then the 'B' valve is checked to see if it is active. Only during the injection mode is a shut-in permitted if the limit is other than line and the 'B' valve is active. If an open limit or a close limit, other than line, is set, then the subroutine will see if a limit delay has been programmed in and if so whether the limit delay time has already been started. If a limit time is present but not started then the time will be active and delay the shut-in or turn on action until after countdown.

Figure 7A:
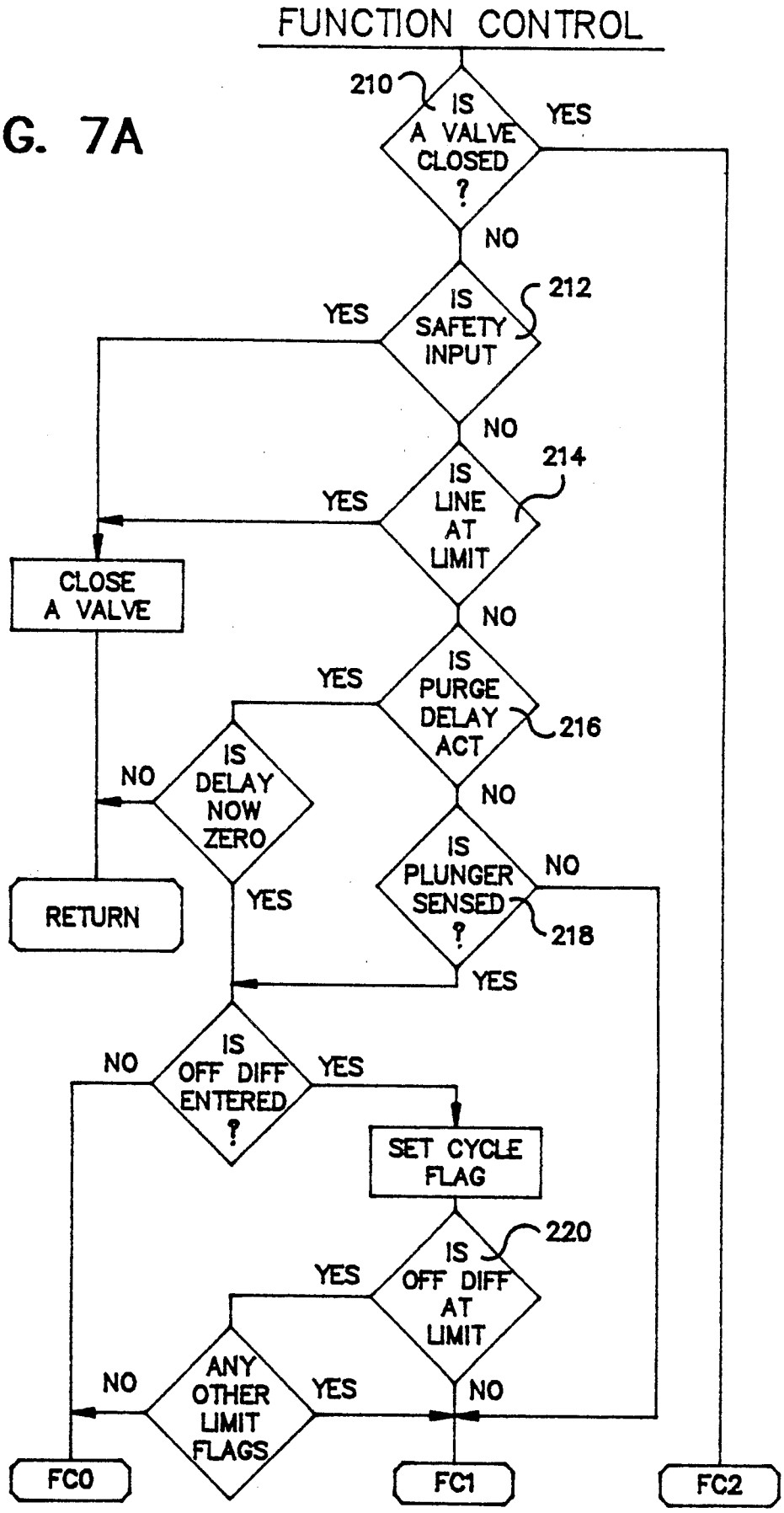
Figure 7B:
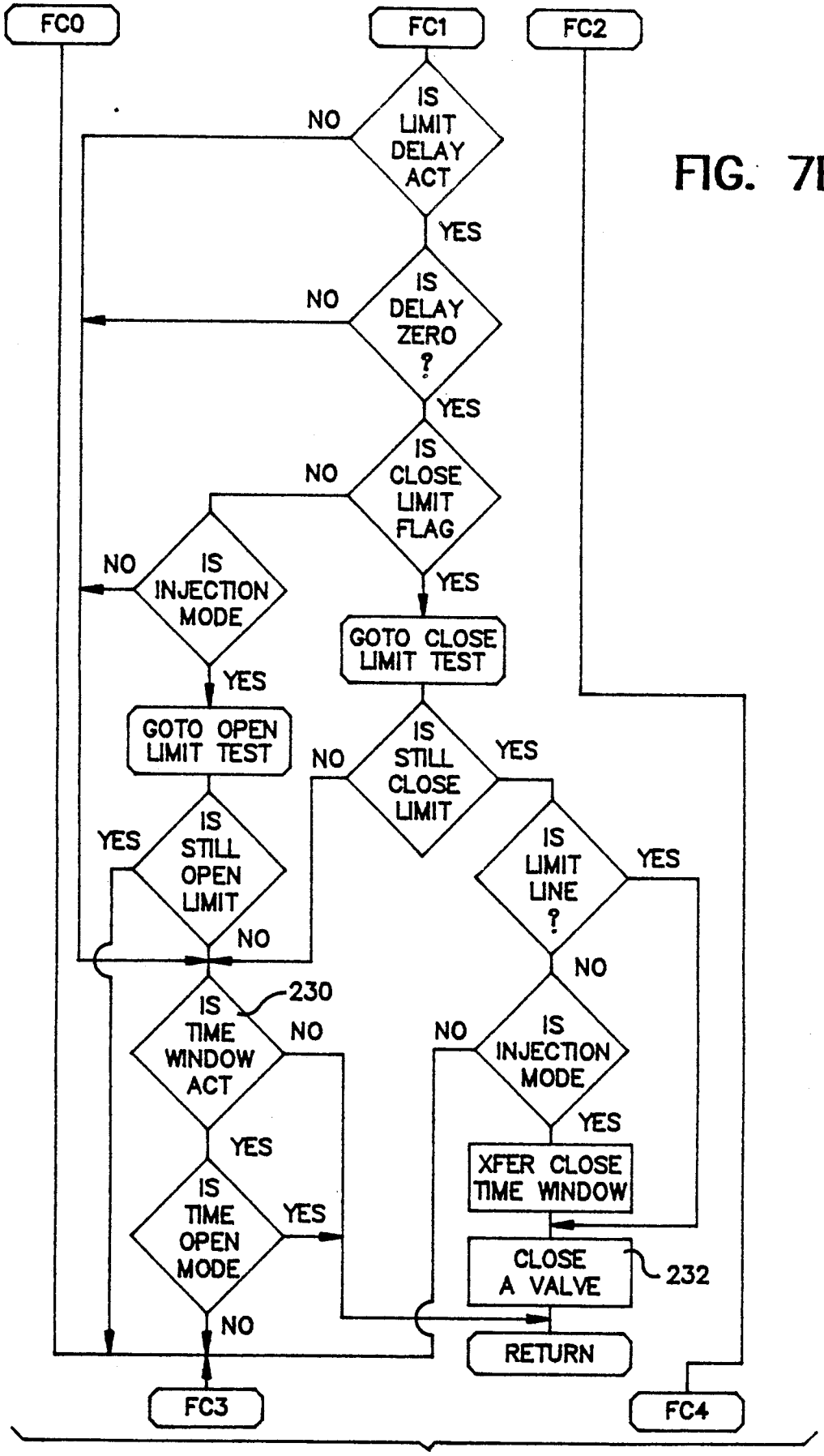
Figure 7C:
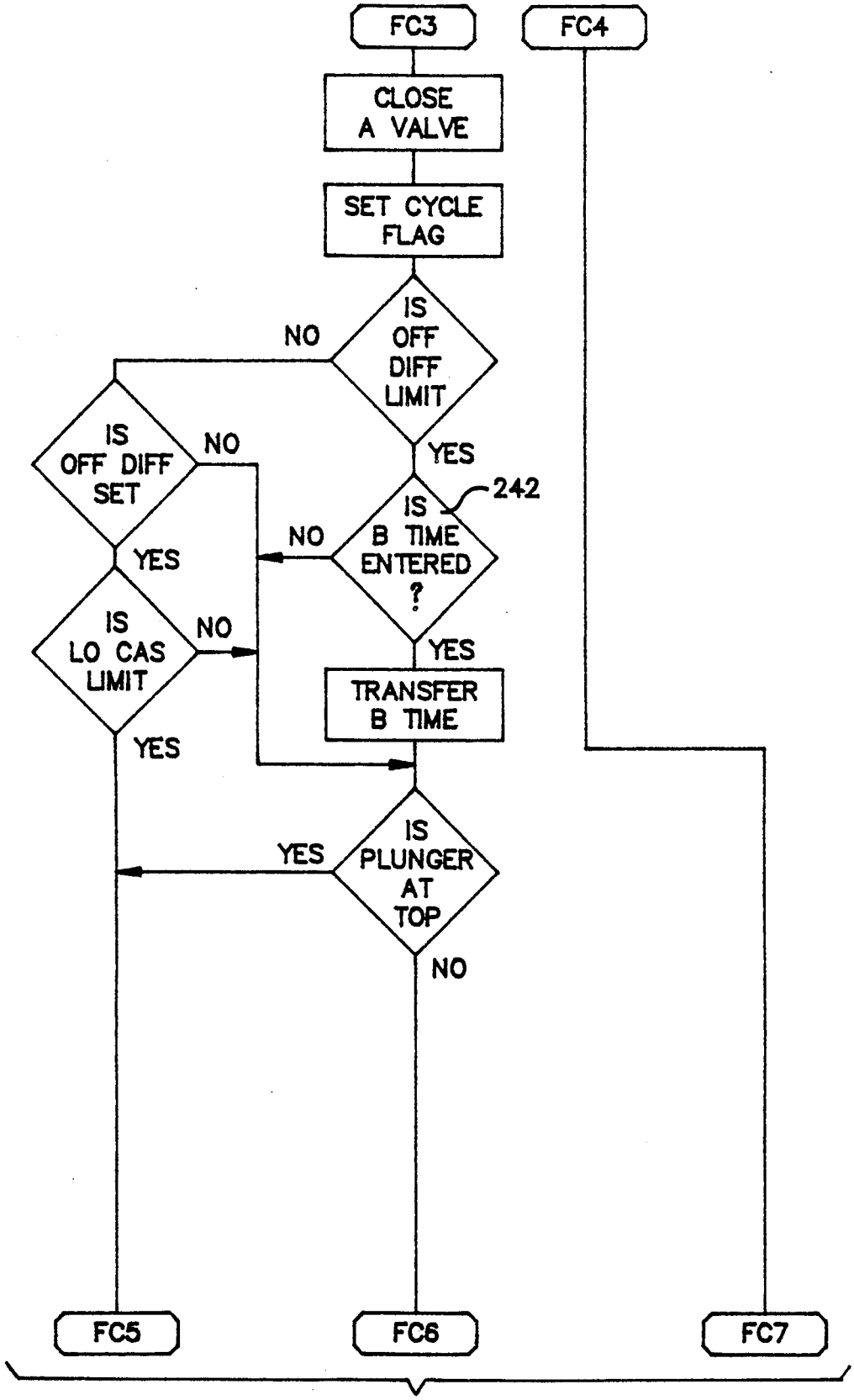
Figure 7D:
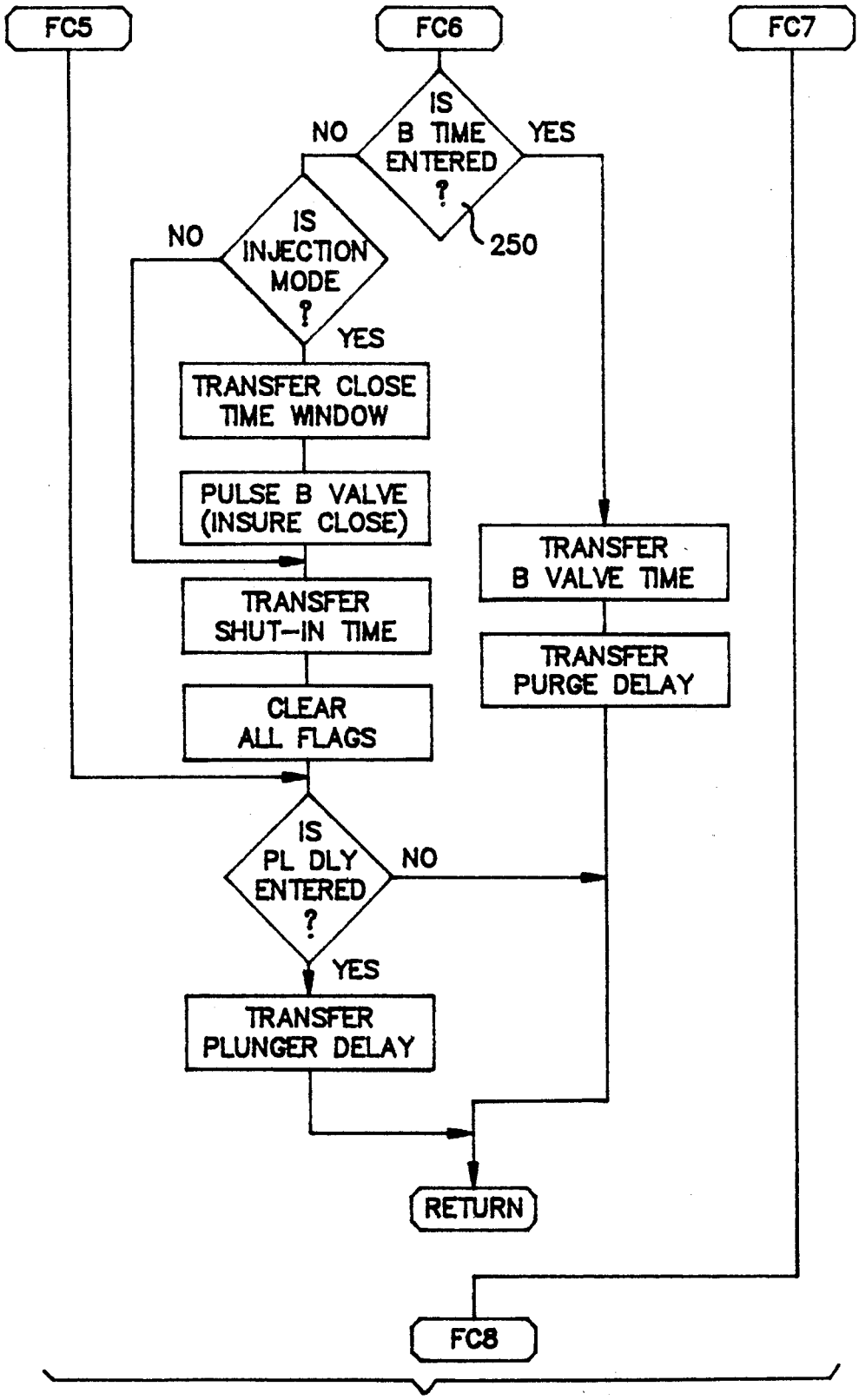
Figure 7E:
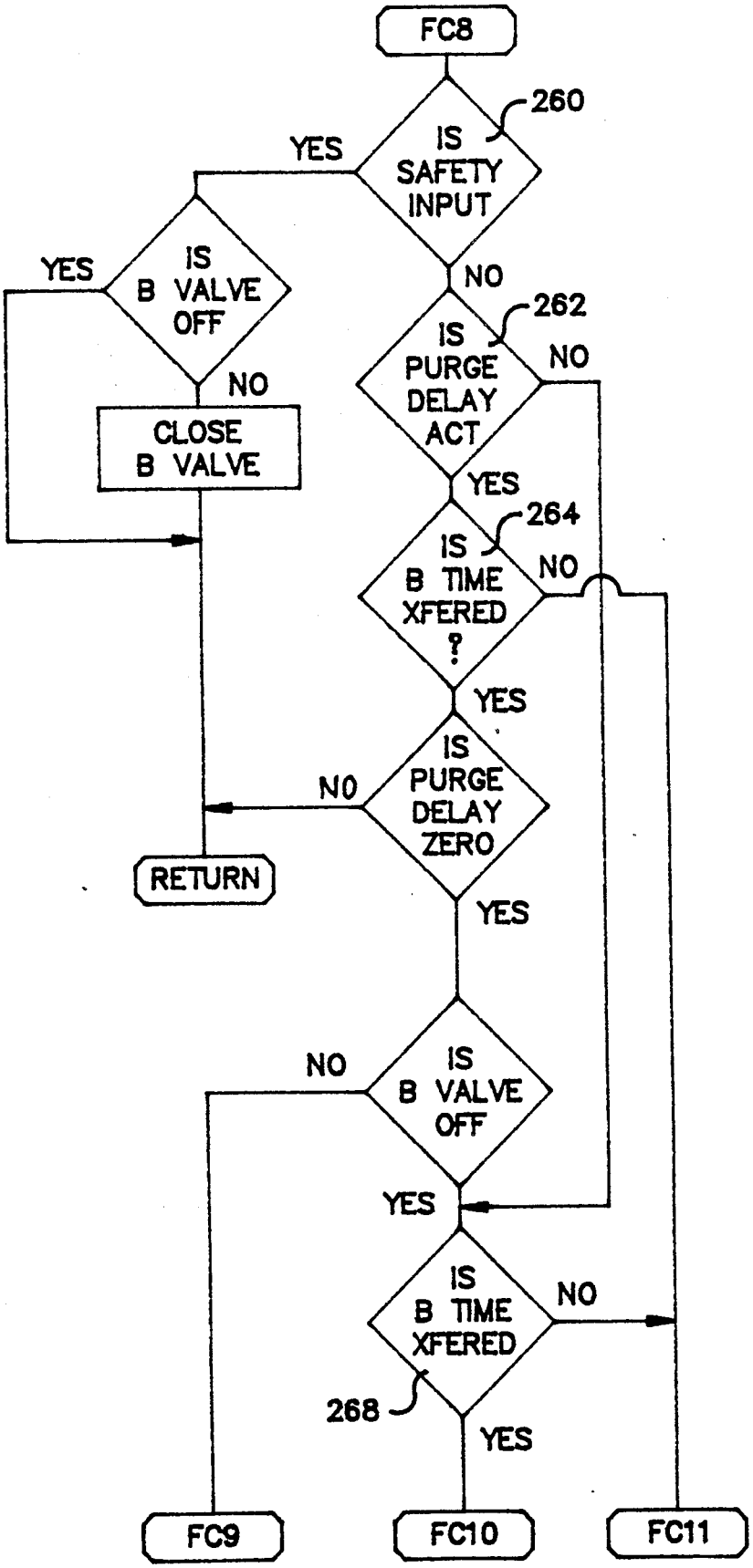

With reference now to FIGS. 7A–7I, the function control sequence will coordinate the various times, delays, and options entered with the current systems status and determines which action, if any, is to be taken. This sequence is performed no less than once per second to insure timely control functions. The function control algorithm section will first check if the 'A' valve is closed as shown in block 210. If it is, then the routine will check if the safety input is still active as shown in FIG. 7E. On the other hand, if the 'A' valve is not closed, then the routine will determine if the valves must be changed and if any times or delays must be started as shown in decision block 212. If the safety input is active, then the 'A' valve is closed and the routine ends. On the other hand, if the safety input is not active then the program will determine if the line limit flag has been set as shown in block 214. If so, then the 'A' valve is again closed and there is a temporary shut-in. If, on the other hand, the line is not at its limit, then the program checks whether the purge delay is active as shown at 216. If the purge delay is still active and is not zero then the 'A' valve will remain open. The purge delay was started when the plunger was first sensed, therefore, if the delay is now zero the routine will skip to the next test. If there is no purge delay, then the routine checks to see whether the plunger is at the top of its cycle as shown in block 218. If there is an off differential entered, then the system will not shut with plunger arrival but will wait until the off differential is at its limit as shown at block 220. The cycle flag will tell the system that it is now in a shut-in mode. If the off differential is at limit, and no other limits are active, then the system goes to a shut-in condition. Other limits must be checked and the limit delay time must be tested.

With reference now to FIG. 7B, if any limits are active at this point in the routine and a limit delay has been entered, then a limit delay may be active. If so, it will prevent the limit from being acted upon until it has timed out. If the delay is zero, the limit is tested for type of limit, and if it is a closed limit then there is a retest to see if it is still active. An open limit is normally ignored at this point except in the injection mode where a high casing limit initiates the closure of the injection supply valve, which for the injection mode is the 'A' valve. If in the injection mode, the open limit is retested and if still at the limit then the 'A' valve is closed. If no limit is active after retest from either path, then the next test is of the time window as shown in block 230. If the line limit indicates too high of a sales line pressure or a broken or open sales line, then the line limit will have been exceeded and the 'A' valve will be temporarily closed as shown in block 232. If the line limit is not active, then another closed limit is and would normally cause an end of production cycle except if in the injection mode. In the injection mode, all open time remaining will be terminated and the close time will be transferred before closing the 'A' valve.

With reference now to FIG. 7C, when the 'A' valve is closed and the cycle flag is set to indicate completion of the production cycle, this section of the function control system will determine whether the bypass or 'B' valve should be opened. If the 'A' valve was shut-in by the off differential limit the routine checks whether the 'B' valve time is entered and transfers the 'B' valve time, as shown in decision block 242. On the other hand, if the shut-in was not by the off differential limit then the routine will see if it was done by the low casing limit. The low casing limit will not initialize the bypass valve if there is any off differential entries. This is an option to bypass operation when the casing pressure is too low. If the plunger has arrived before the shut-in of the 'A' valve then the routine goes to the plunger delay sequence shown in FIG. 7D. If it has not arrived, then the routine determines if the 'B' valve should be made active or if the shut-in time should be initiated.

With reference now to FIG. 7D, if the plunger was not at the top of the tubing then it was shut-in by the 'A' limit or the end of open time. Now the routine checks to see if any 'B' valve time was entered as shown in block 250. If it was, then the 'B' valve time is transferred and also the purge delay time is transferred to allow the 'A' valve to fully close before opening the 'B' valve. If no 'B' valve time was entered, then the routine checks to see if the injection mode is active. If so, then the operator entry error will transfer the closed time window and insure that the 'B' valve is closed. On the other hand, if the program finds that it is not in the injection well mode then the well is shut-in. If the plunger was sensed, then the shut-in is produced in the normal mode and a plunger delay is needed to allow the plunger to drop down the tubing before the system can reopen the valve with an open limit setting or a fast close time entry. If no plunger delay has been entered, then the system may reopen the 'A' valve immediately with an open limit.

With reference now to FIG. 7E, this section of the routine will determine whether the 'B' valve or the 'A' valve should be opened. If the safety input is still active as shown in decision block 260, then the system makes sure that the 'B' valve is off and the routine is ended. If there is no safety input then the system sees whether a purge delay is active as shown in decision block 262. If it is active, then the system sees whether the 'B' valve time has been transferred as shown in decision block 264. This delay may or may not be delaying the opening of the 'B' valve after an 'A' valve shut-in. If the 'B' valve time has been transferred, then the system checks to see if the delay is now zero. If not, the routine is over. If the 'B' valve time has been transferred, then the 'B' valve should be open but may be held closed by a limit of some type or a plunger delay. If the 'B' valve is off, the system checks to see whether the 'B' time is transferred as shown in decision block 268. This test is redundant for the condition of the purge delay not being active.

Figure 7F:
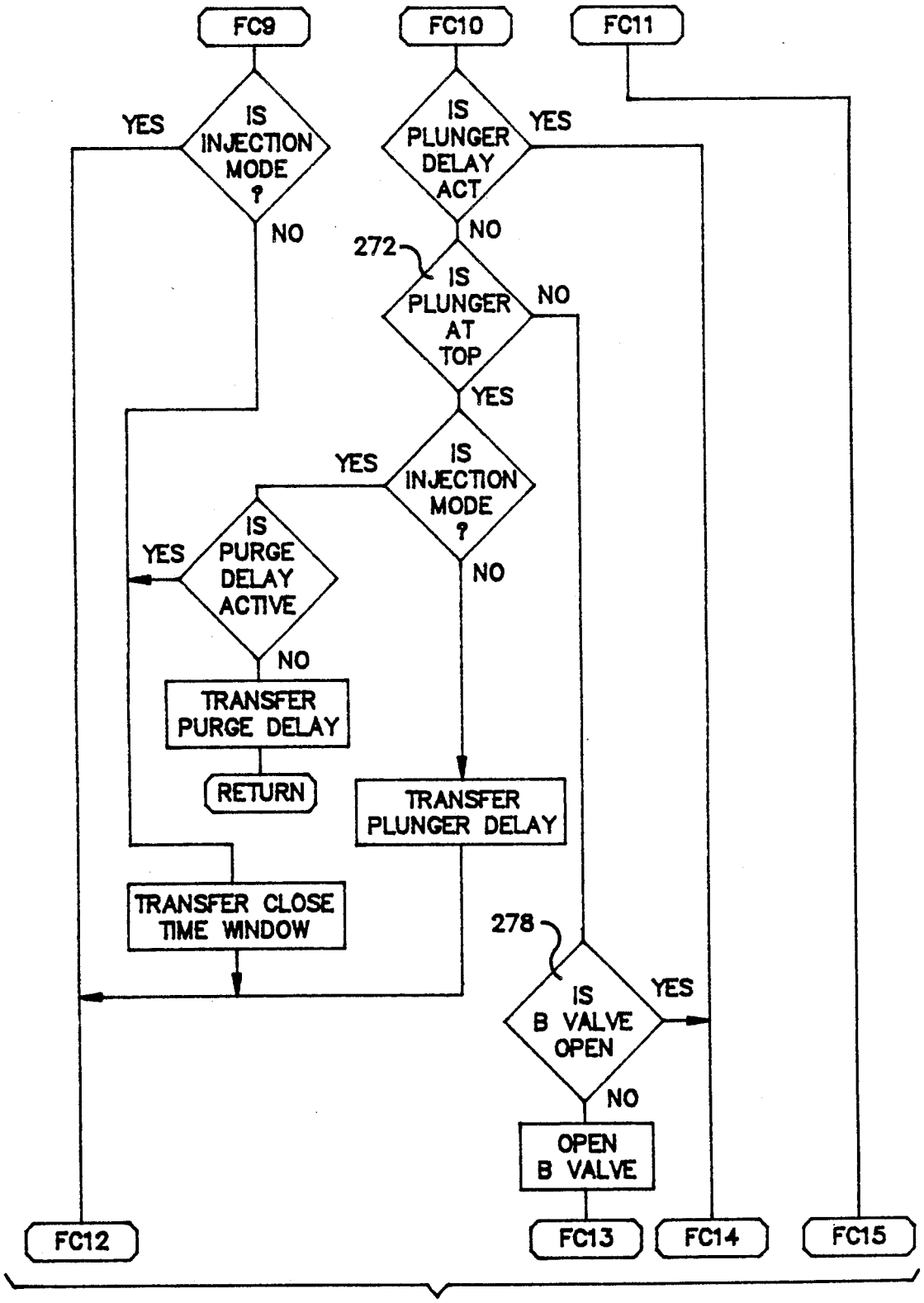

With reference now to FIG. 7F, if the 'B' valve time is transferred then the system checks to see whether the plunger delay is still active. If it is not then the system checks to see whether the plunger is at the top of the tubing as shown in decision block 272. If it is at the top, then it must have come up with the 'B' valve. If the 'B' valve is open and if the system is in the injection mode, then the close time window is transferred. If the 'B' valve is closed and the plunger is at the top but no plunger delay is active, and if the system is in the injection mode, then the purge delay time is transferred if not active or if not in the injection mode then the plunger delay time is transferred. If the system is in the injection mode then the purge will be active on plunger arrival as the 'B' valve is the production valve. If the system is not in the injection mode then the plunger delay will be active on the plunger arrival to permit the plunger to return to the bottom. If the plunger is not at the top and the plunger delay is not active then the system will check whether the 'B' valve is open as shown in block 278. If the 'B' valve is not open under these circumstances, then the system will open the 'B' valve.

Figure 7G:
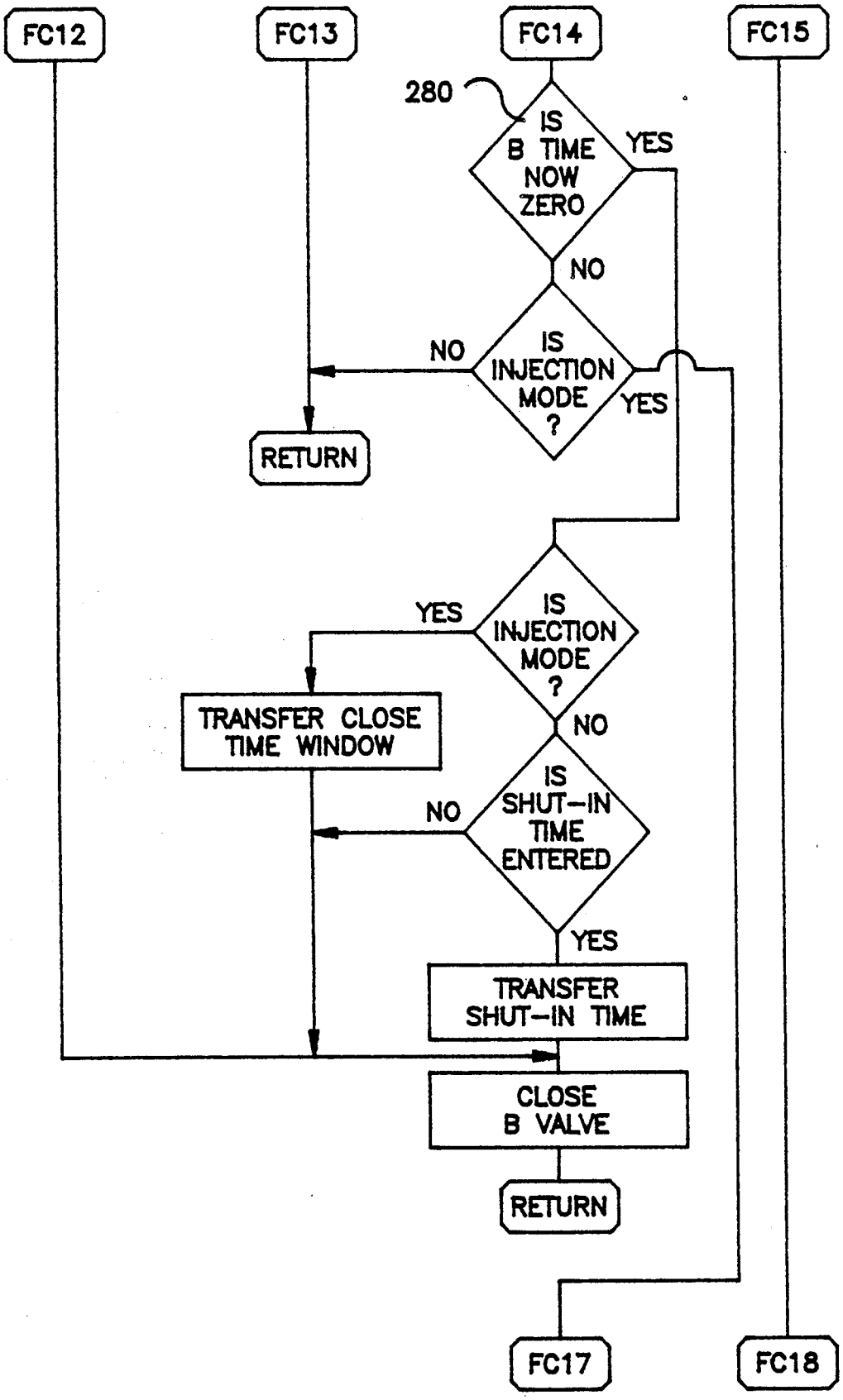

With reference now to FIG. 7G, if the 'B' valve is active the system will check to see whether the 'B' valve time is now timed out to zero as shown in block 280. If the system is not timed out and if it is not in the injection mode then the routine comes to an end. If it is not timed out and is in the injection mode then the system goes to the limit check section. If the 'B' time is zero then if in the injection mode the close time window is transferred and the 'B' valve is closed. If the 'B' time is zero and the system is not in the injection mode then the system will see if the shut-in time has been entered. If so, then the shut-in time is transferred and all valves are closed for the duration of the time. If the 'B' time is zero then the system checks to see if any shut-in time was entered. If the 'B' time ran out before the plunger arrived at the top and some shut-in time was entered then the shut-in time is transferred and the system is shut-in until it times out. The closure of the 'B' valve completes the 'B' operation.

Figure 7H:
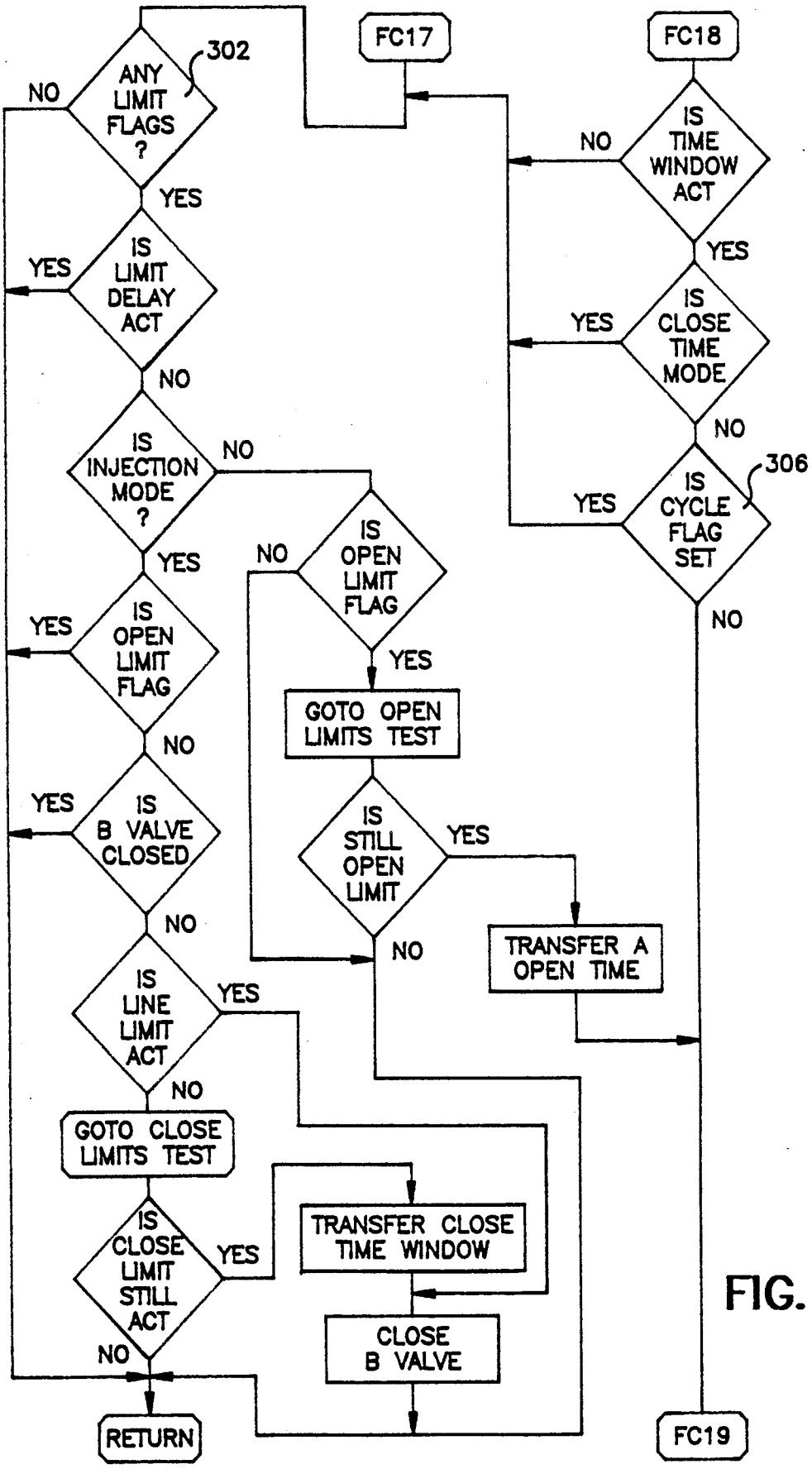

With reference now to FIG. 7H, the system now checks to see whether the 'A' time window which is used for constant time sync is active. If the time is still in the close mode then the system checks the limits to see if there are any open limit flags pending as shown in block 302. If the time has transferred to the open mode, then the system checks to see if the cycle flag which is used to indicate a closed mode pending, is set as shown in block 306. If there is no cycle flag then the system checks to see if the 'A' valve will be permitted to open. Else, if an open limit flag is set then there is a retest to see whether the open limit is still valid. If so, then there is a transfer of the 'A' valve open time to see if the system will permit the 'A' valve to open. If the limit was not valid then there is a return and a wait until the next pass. If in the injection mode, and the open limit is not active then the 'B' valve is open and if the line limit is not the active limit then retest the close limit. If the close limit is still active, then the system will transfer the close time limit and close the 'B' valve. If the close limit was a line limit period then the 'B' valve is closed temporarily.

Figure 7I:
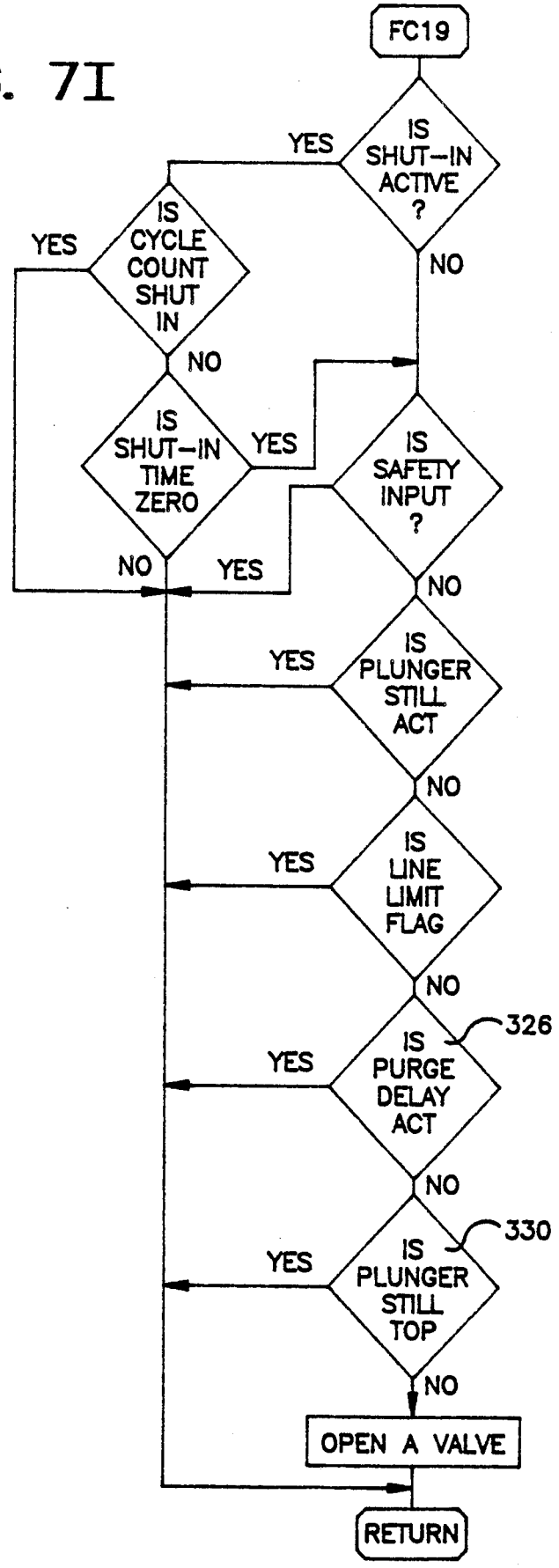

Finally, with reference to FIG. 7I, the routine will now test the system to see whether there are any overriding inputs or conditions which will keep the 'A' valve closed. The first test is an override which may only be reset before times out by manual open. If shut-in was transferred then only when it times out may the system consider the other conditions prior to opening the 'A' valve. If the shut-in was indicated by the maximum cycle count used to catch the plunger, the shut-in will not time out. The next condition which will hold the 'A' valve off is the safety input. If the plunger delay is still active then the system will wait until it times out. The line limit is a flag which will hold the 'A' valve off until the line condition falls again within the preset limits. Various functions may overlap and this test of the purge delay is a redundancy test to insure that the 'A' valve does not open until the system has cleared the purge as shown in block 326. The purge delay active decision block is a redundancy test to insure that the 'A' valve does not open until the system has cleared the purge since various functions may overlap. With reference now to block 330, the fast cycle or fast recovery of a shut-in may try to reopen the 'A' valve while the plunger is still at the top. This check will insure that a minimal delay is observed. The final function is the opening of the 'A' valve and a return to the system.

With particular reference again to FIG. 3A, the key pad 120 and display 132 as would be included in the controller of the present invention are illustrated. The commands to be entered from the key board are shown in the following command table:

| Commands | |
|---|---|
| Read or Set Open Time Window | Read/Set, on, 1 |
| Read or Set Close Time Window | Read/Set, off, 1 |
| Read or Set 'B' Valve | Read/Set, on, 4 |
| Read or Set Shut-in Time | Read/Set, off, 4 |
| Read or Set Limit Delay Time | Read/Set, on, 2 |
| Read or Set Purge Delay Time | Read/Set, off, 2 |
| Read or Set Plunger Delay Time | Read/Set, off, 7 |
| Read or Set Log Delay Time | Read/Set, on, 7 |
| Read or Set High Casing Pressure Limit | Read/Set, on, 3 |
| Read or Set Low Casing Pressure Limit | Read/Set, off, 3 |
| Read or Set High Line Pressure Limit | Read/Set, on, 6 |
| Read or Set Low Line Pressure Limit | Read/Set, off, 6 |
| Read or Set Open Differential Pressure Limit | Read/Set, on, 5 |
| Read or Set Off Differential Pressure Limit | Read/Set, off, 5 |
| Read or Set Maximum Cycle Count | Read/Set, off, 8 |
| Read or Set Total Open Time | Read/Set, on, 9 |
| Read or Set Total Cycles | Read/Set, off, 9 |
| Read or Set Well Identification Number | Read/Set, on, 8 |
| Read or Set the Total Gas Produced | Read/Set, on, 0 |
| Read or Set the Total Fluid Produced | Read/Set, off 0 |
| Read the System Battery Voltage | Read, 0 |
| Read Status and Current Time Window | Read, 1 |
| Read Current Active Delay | Read, 2 |
| Read the Casing Pressure | Read, 3 |
| Read the Active 'B' Valve Time | Read, 4 |
| Read the Differential Pressure | Read, 5 |
| Read the Line Pressure | Read, 6 |
| Read the Active Shut-In Time | Read, 7 |
| Read the Current System Status | Read, 8 |
| Read the Tubing Pressure | Read, 9 |
| Read the Optional Analog 'A' Input | 0, Read, 1 |
| Read the Optional Analog 'B' Input | 0, Read, 2 |
| Set Value for Low Battery Alarm | Set, 0, Ent |
| Enter the Calibration Value for Optional Analog 'A' | Set, 1, Ent |
| Enter the Calibration Value for Optional Analog 'B' | Set, 2, Ent |
| Enter the Calibration Value for Casing PSI | Set, 3, Ent |
| Enter the Log Operation Mode | Set, 4, Ent |
| Set the Real Time Clock | Set, 5, Ent |
| Enter the Calibration Value for Line PSI | Set, 6, Ent |
| Enter the Calibration Value for Total Fluid | Set, 7, Ent |
| Enter the Calibration Value for Total Gas | Set, 8, Ent |
| Enter the Calibration Value for Tubing PSI | Set, 9, Ent |
| Manual Open Override Command | On, Ent |
| Manual Close Override Command | Off, Ent |
| Manual 'B' Valve Open Override Command | Off, 0, Ent |
| Manual 'B' Valve Close Override Command | Off, 0, Ent |
| Manual Option Valve Override Command | On, 5, Ent |
| Manual Option Valve Close Override Command | Off, 5, Ent |
| Manual Plunger Hold Command | On, 8, Ent |

-continued

| Commands | |
|---|---|
| Manual Plunger Release Command | Off, 8, Ent |
| Dump Log Command | Read, Ent |

The above commands are recognized in the function table and stored in the microcomputer memory. The commands are self-explanatory from the table. In each case, the set and read buttons are used in entering the commands.

For example, the read or set open time window command is obtained by pressing first the read button or the set button then the 'on' button and the number 1 button. This gives the maximum time allowable for the main production valve in the time cycle or differential mode. Alternatively, it gives the maximum open time allowable for the injection source valve in the injection mode. The open time may be terminated in the injection mode by plunger arrival and purge delay time out, low casing pressure, or 'B' valve time out. In the time cycle and differential mode, the open time window may not be terminated but may be reset to maximum after the plunger arrival and purge and plunger delays by a high casing (open) limit, and on differential limit, or an optional low line (open) limit.

As another example, the read or set, on, 4 command will give the maximum open time allowable for the bypass valve in the time cycle and differential modes and the maximum open time for the main production valve in the injection mode. The 'B' valve time may be terminated with the time out of the maximum open time window in the injection mode or plunger arrival or a low casing limit in all modes.

As a further example, the read or set, on, 2 command will give the delay time which the system allows after a programmed limit has been exceeded. This delay smooths out irregular pressure measurements during expected or allowable pressure surges. After the delay, the system will take another measurement and if the limit is still exceeded, the appropriate limit flag is set for action to be taken. The types of limits are assigned priorities and if a limit of a higher priority occurs, the current limit delay will be terminated. The high and low line limits are not delayed but initiate immediate action.

Another example is the "read or set, on, 3" command which gives the high casing pressure limit. This limit becomes active when the casing pressure increases to greater than the limit value entered. This value is the minimum pressure limit required to initiate a production cycle in the time cycle or differential mode. If set, it will override the close time window but may not override any other times or limits. In the injection mode, this limit is used to close the injection supply valve and permit the conditional opening of the production valve.

Conversely, the "read or set, off, 3" command will give the low casing pressure limit. This limit becomes active when the casing pressure falls below the limit value entered. When the limit is active, all production cycles are terminated. In the time cycle or differential mode, if the limit is exceeded while the main production valve is open, it will be closed and may not reopen until the completion of the open/close cycle. If any 'B' time has been entered and the plunger has not arrived, the 'B' valve will open to discharge fluids directly to the fluid storage tank if possible. In the injection mode, if the limit is still exceeded after the limit delay while the injection source valve is open, insufficient source pressure is indicated and the open cycle will terminate. If the limit is exceeded while the production valve is open in the injection mode, the open cycle will be terminated.

It should be noted that the invention is not limited by the foregoing commands and entries. Additional functions or operations may be specified by appropriate modifications of the firmware.

The plunger arrival, safety input, keypad entry, communications port, and the real time clock all initiate an immediate response and action by the microcomputer through its interrupt inputs.

All tests and functions are normally performed by the microcomputer within a few milliseconds. The system may then be shut-down for a large percentage of the remaining one second cycle to conserve power. Specific sections of the system, such as the analog subsystem, may be individually turned-on as required to further conserve power.

The invention has been described with reference to the preferred embodiments. Obviously, modifications and alterations will occur to others upon a reading and understanding of the specification. It is my intention to include all such modifications and alterations insofar as they come within the scope of the appended claims or the equivalents thereof.

Having thus described the invention, I claim:

1. A control system for a plurality of gas and oil well installations of the type each having a well casing and a tubing therein, a lower end of the tubing being open adjacent to a lower portion of the casing and an upper end of the tubing being connectable to a sales line, comprising:

a main production valve for selectively communicating the tubing with the sales lines and an auxiliary production valve for selectively communicating the tubing with a liquid storage tank or an injection fluid supply source with the casing;

a casing pressure sensing means for detecting the pressure in the well casing;

a tubing pressure sensing means for detecting the pressure in the tubing upstream from said main production valve;

a line pressure sensing means for detecting the pressure in the sales line;

a microcomputer means in operative communication with said main production valve and said auxiliary valve, said casing pressure sensing means, said tubing pressure sensing means, and said line pressure means for opening and closing said main production valve to selectively communicate the sales line with the tubing including means for synchronized production for the plurality of installations comprising means for inhibiting production during a close time period to sequence respective start times at the plurality of installations, said microcomputer means including means for reversing said main production valve and said auxiliary production valve to enable the well to be operated in a casing injection mode comprising means for operating the auxiliary valve as a supply injection valve to control the flow of injection fluid from said supply source to the casing;

an input/output buffer means through which said microcomputer means provides an output signal to control the operation of said main production valve and said auxiliary production valve; and, a plunger hold means for holding a plunger, which reciprocates in the tubing, adjacent a top position in the tubing, wherein said microcomputer means provides a control signal through said input/output buffer means to control the actuation of said plunger hold means to hold the plunger for inspection and cleaning after a preselected maximum number of plunger cycles.

2. The system of claim 1 wherein said control circuit means comprises:

a keyboard entry means for enabling control parameters to be programmed in said microcomputer means;

a first input means for providing input data to said microcomputer means; and, a main power source for powering said microcomputer means.

3. The system of claim 2 wherein said first input means comprises an analog sub-system through which said casing pressure sensing means, said tubing pressure sensing means and said line pressure sensing means are communicated with said microcomputer means and further comprising a second input means for providing input data to said microcomputer, said second input means comprising an input gate and at least one means for generating an input signal.

4. The system of claim 2 wherein said microcomputer means further comprises:

a real time clock for providing log time information for said microcomputer means; and, an independent timer for providing an independent timing signal for said microcomputer means in the event of a failure of said real time clock.

5. The system of claim 4 wherein said microcomputer means further comprises:

a display module for indicating status, time and pressure parameters;

a memory for storing data; and, a standby power source for powering said memory and said independent timer in the event of a failure of said main power source.

6. The system of claim 1 further comprising a flow meter means for measuring the flow of fluid through the tubing, said microcomputer means being in operative communication with said flow meter means.

7. A control system for cyclically and sequentially controlling the operation of a plurality of gas and oil wells between an open, producing, state and a closed, shut-in, state, the gas and oil well having a casing, a tubing, a gas sales line, a plunger, a main production valve intermediate the casing and the sales line and an auxiliary production valve for selectively communicating the tubing with a liquid storage tank or an injection fluid supply source with the casing, the control system including an apparatus at each of the plurality of gas and oil wells comprising:

sensor means for forming signals indicative of pressures in the casing, tubing and sales line;

a production valve controller means and an auxiliary valve controller means operatively connected to the main and auxiliary production valves for selectively altering the operative condition of the valves; and, control circuit means for actuating said valve controller means at desired intervals as set by time limit, pressure limit and sensed condition parameters, wherein said sensor means is in operative communication with said control circuit means, said control circuit means comprising:

a programmable memory means for storing preselected time limit and pressure limit parameters for the regulation of the main production valve, means for programming said memory means to store said preselected time limit and pressure limit parameters, timing means for decrementing said preselected time limit parameters programmed in said memory means and indicating when each of said time limit parameters has expired to enable the actuation of said production valve controller means and further including means for overriding pressure limits for sequential operation of the plurality of gas and oil wells; and, means to reverse the functions of the main production valve and the auxiliary production valve when it is desired to operate the gas and oil well in the casing injection mode comprising means for operating the auxiliary valve as a supply injection valve to control the flow of injection fluid from said injection fluid supply source to the casing.

8. The apparatus of claim 7 wherein said control circuit means further comprises:

a clock means for counting intervals of time;

a display means for displaying selected information concerning time, pressure and status parameters; and, a power means for energizing said control circuit means.

9. The apparatus of claim 7 further comprising:

a plunger sensing means for sensing the position of the plunger adjacent a top position in the tubing, said plunger sensing means being in operative communication with said control circuit means.

10. The apparatus of claim 7 further comprising a plunger hold means for holding the plunger adjacent a top position in the tubing, said plunger hold means being actuated by said control circuit means.

* * * * *